US012546323B2

(12) United States Patent
Tanaka et al.

(10) Patent No.: US 12,546,323 B2
(45) Date of Patent: Feb. 10, 2026

(54) COMPRESSOR WITH CURVED PASSAGE

(71) Applicant: IHI Corporation, Tokyo (JP)

(72) Inventors: Ryuuta Tanaka, Tokyo (JP); Yosuke Akamatsu, Tokyo (JP); Satoshi Ouchida, Tokyo (JP); Masahiro Nakajima, Tokyo (JP); Seiichiro Yoshinaga, Tokyo (JP)

( * ) Notice: Subject to any disclaimer, the term of this patent is extended or adjusted under 35 U.S.C. 154(b) by 0 days.

(21) Appl. No.: 18/826,197

(22) Filed: Sep. 6, 2024

(65) Prior Publication Data

US 2024/0426303 A1 Dec. 26, 2024

Related U.S. Application Data

(63) Continuation of application No. PCT/JP2023/007878, filed on Mar. 2, 2023.

(30) Foreign Application Priority Data

Mar. 16, 2022 (JP) ..... 2022-041560

(51) Int. Cl.
*F04D 17/12* (2006.01)
*F04D 29/44* (2006.01)

(52) U.S. Cl.
CPC ..... *F04D 17/122* (2013.01); *F04D 29/441* (2013.01)

(58) Field of Classification Search
CPC .... F04D 17/122; F04D 17/125; F04D 29/403; F04D 29/42; F04D 29/4206; F04D 29/44;
(Continued)

(56) References Cited

U.S. PATENT DOCUMENTS 3,623,511 A * 11/1971 Levin ..... F15D 1/04 415/224
5,363,674 A 11/1994 Powell
(Continued)

FOREIGN PATENT DOCUMENTS

CN 207278540 4/2018
EP 3361104 8/2018
(Continued)

OTHER PUBLICATIONS

SOEI Patent and Law Firm, Statement of Related Matters, dated Nov. 5, 2024.
(Continued)

*Primary Examiner* — Brian P Wolcott
(74) *Attorney, Agent, or Firm* — SHIPWAY IP

(57) ABSTRACT

A compressor including an impeller housing accommodating a first impeller configured to compress a fluid and a second impeller configured to further compress the fluid, and an interstage component forming, together with the impeller housing, an interstage passage that includes a curved passage. The curved passage is formed by an inner wall surface that is curved, and by an outer wall surface that is curved. A first wall surface selected from the inner wall surface and the outer wall surface is formed by the impeller housing, and a second wall surface selected from the inner wall surface and the outer wall surface is formed by the interstage component. A distance between the inner wall surface and the outer wall surface is constant along an entire length of the curved passage.

20 Claims, 10 Drawing Sheets

(58) Field of Classification Search
CPC ..... F04D 29/441; F04D 29/60; F04D 29/601; F04D 29/624
See application file for complete search history.

(56) References Cited

U.S. PATENT DOCUMENTS

| | | | | |
|---|---|---|---|---|
| 6,155,802 | A | 12/2000 | Choi et al. | |
| 7,942,628 | B2 * | 5/2011 | Takahashi | F25B 1/053 415/206 |
| 10,100,792 | B2 * | 10/2018 | Kanzaka | F04D 25/04 |
| 10,514,041 | B2 * | 12/2019 | Fujii | F16C 27/02 |
| 12,152,601 | B2 * | 11/2024 | Okano | F04D 29/083 |
| 2007/0147984 | A1 | 6/2007 | Takahashi et al. | |
| 2009/0220338 | A1 * | 9/2009 | Letka | F04D 29/057 417/423.12 |
| 2012/0240580 | A1 | 9/2012 | Takemaru et al. | |
| 2015/0267717 | A1 | 9/2015 | Fujii et al. | |
| 2017/0146271 | A1 | 5/2017 | Hasegawa et al. | |
| 2017/0335756 | A1 | 11/2017 | Donkin | |
| 2021/0285691 | A1 | 9/2021 | Webb et al. | |
| 2022/0136744 | A1 | 5/2022 | Hasegawa et al. | |
| 2025/0180035 | A1 * | 6/2025 | Hirano | F04D 17/12 |

FOREIGN PATENT DOCUMENTS

| | | |
|---|---|---|
| JP | H3-019498 | 2/1991 |
| JP | H8-509802 | 10/1996 |
| JP | H11-230098 | 8/1999 |
| JP | 2000-240596 | 9/2000 |
| JP | 2003-269394 | 9/2003 |
| JP | 2007-177695 | 7/2007 |
| JP | 2009-511803 | 3/2009 |
| JP | 2009-270797 | 11/2009 |
| JP | 2010-071082 | 4/2010 |
| JP | 2012-202331 | 10/2012 |
| JP | 2015-178866 | 10/2015 |
| JP | 2016-033348 | 3/2016 |
| JP | 2018-119728 | 8/2018 |
| JP | 2019-090602 | 6/2019 |
| JP | 2021-085512 | 6/2021 |
| WO | 94/025808 | 11/1994 |
| WO | 2007/041818 | 4/2007 |
| WO | 2021/038737 | 3/2021 |

OTHER PUBLICATIONS

International Search Report dated May 23, 2023 for PCT/JP2023/008623.
International Search Report dated Apr. 25, 2023 for PCT/JP2023/007878.
International Preliminary Report on Patentability with Written Opinion dated Sep. 26, 2024 for PCT/JP2023/008623.
International Preliminary Report on Patentability with Written Opinion dated Sep. 26, 2024 for PCT/JP2023/007878.
Extended Search Report in corresponding European Application No. 23770444.0, dated Dec. 23, 2025.

* cited by examiner

COMPRESSOR WITH CURVED PASSAGE

CROSS-REFERENCE TO RELATED APPLICATIONS

This application is a continuation application of PCT Application No. PCT/JP2023/007878, filed on Mar. 2, 2023, which claims the benefit of priority from Japanese Patent Application No. 2022-041560, filed on Mar. 16, 2022, the entire contents of which are incorporated herein by reference.

BACKGROUND

WO 2021/038737, Japanese Unexamined Patent Publication No. 2012-202331, and Japanese Unexamined Patent Publication No. 2021-085512 disclose techniques relating to compressors. As such compressors, a multistage compressor including two or more compression stages are known. A multistage compressor includes, for example, a former compression stage that intakes and compresses a fluid, and a latter compression stage that further compresses the fluid compressed in the former compression stage. Generally, in such a multistage compressor, the former compression stage is connected to the latter compression stage by a pipe, and the fluid from the former compression stage is introduced into the latter compression stage through a passage inside the pipe.

SUMMARY

An example compressor is configured to subject a fluid compressed by a first impeller to further compression by a second impeller. The compressor includes an impeller housing including a first housing accommodating the first impeller, and a second housing accommodating the second impeller, and an interstage component coupled to the impeller housing, and forming, together with the impeller housing, an interstage passage configured to introduce the fluid from the first impeller into the second impeller. The interstage passage includes at least one curved passage. The curved passage includes an inner wall surface that is curved on an inner side in a cross-section passing through a center line of the curved passage, and an outer wall surface that is curved on an outer side in the cross-section. One of the inner wall surface and the outer wall surface is formed in the impeller housing. Another of the inner wall surface and the outer wall surface is formed in the interstage component.

DETAILED DESCRIPTION

Figure 1:
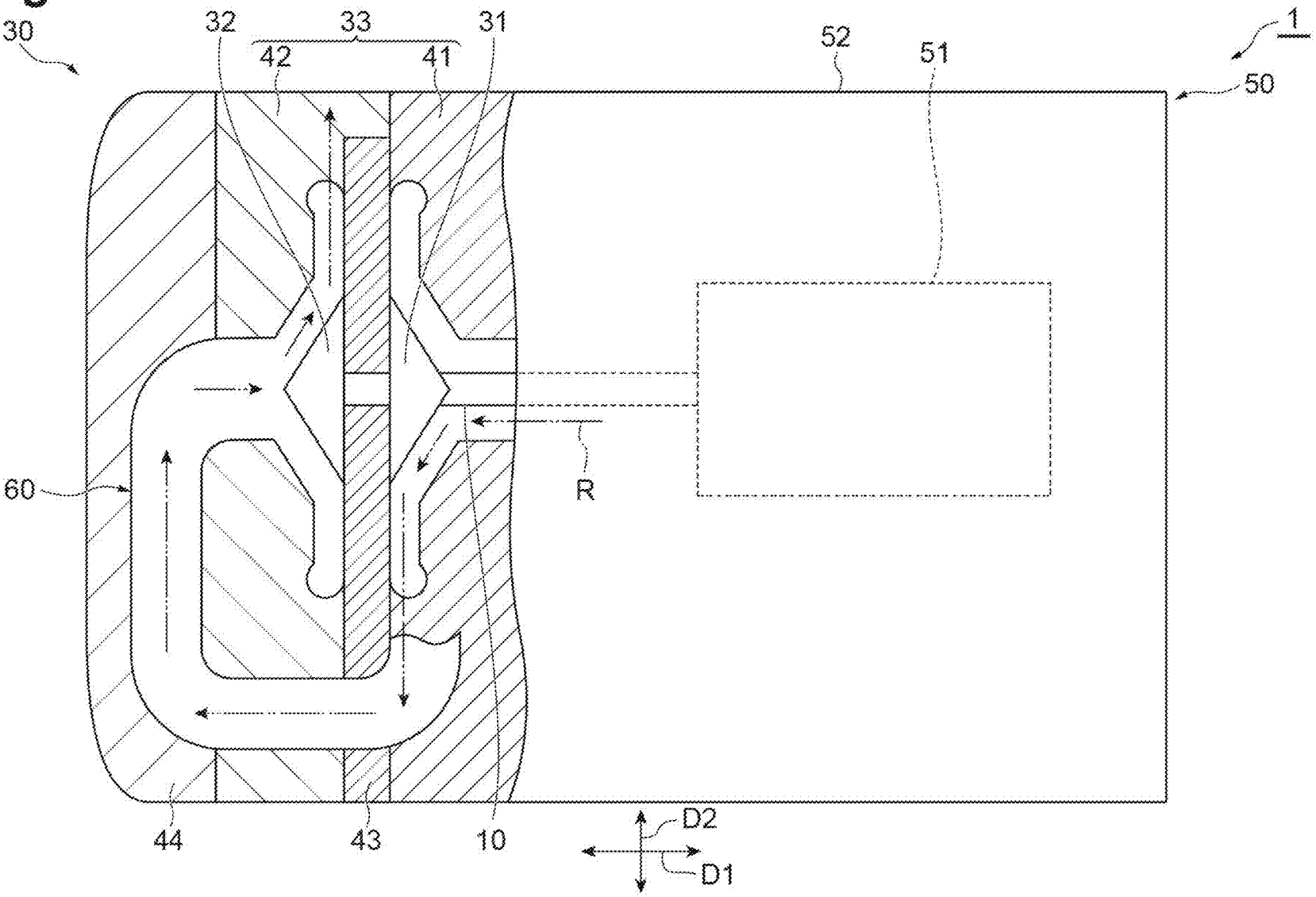
FIG. 1 is a cross-sectional view illustrating an example compressor.

An example compressor is configured to subject a fluid compressed by a first impeller to further compression by a second impeller. The compressor includes an impeller housing including a first housing accommodating the first impeller, and a second housing accommodating the second impeller, and an interstage component coupled to the impeller housing, and forming, together with the impeller housing, an interstage passage configured to introduce the fluid from the first impeller into the second impeller. The interstage passage includes at least one curved passage. The curved passage includes an inner wall surface that is curved on an inner side in a cross-section passing through a center line of the curved passage, and an outer wall surface that is curved on an outer side in the cross-section. One of the inner wall surface and the outer wall surface is formed in the impeller housing. Another of the inner wall surface and the outer wall surface is formed in the interstage component.

In the example compressor above, the interstage passage that introduces the fluid from the first impeller into the second impeller is formed by the impeller housing and the interstage component. One of the inner wall surface and the outer wall surface of the curved passage of the interstage passage is formed in the impeller housing, and the other of the inner wall surface and the outer wall surface is formed in the interstage component. That is, the inner wall surface and the outer wall surface of the curved passage are formed in different housings. In this case, unlike in a case in which the inner wall surface and the outer wall surface are formed in one housing, the forming of an overhanging portion in each component can be avoided, which enables demolding of the components. This enables each component to be formed by die-casting, which has a low production cost. Furthermore, in the configuration above, steps such as preparing a separate pipe for the configuration of the interstage passage and assembling the pipe to the impeller housing can be omitted, so that the assembly man-hours can be reduced. Consequently, the compressor above is capable of improving productivity and suppressing mass production cost.

In some examples, a border line indicating a boundary between the impeller housing and the interstage component in the cross-section may include a first border line and a second border line between the inner wall surface and the outer wall surface. The first border line may extend to intersect a straight line connecting a starting end of the inner wall surface to a starting end of the outer wall surface. The second border line may extend to intersect a straight line connecting a terminal end of the inner wall surface to a terminal end of the outer wall surface. The second border line may be directly or indirectly connected to the first border line between the inner wall surface and the outer wall surface. In this case, the border line can be set to match the shapes of the inner wall surface and the outer wall surface, which eliminates the need to make adjustments such as changing the shapes of the inner wall surface and the outer wall surface to match the border line. As a result, it is possible to avoid the occurrence of situations in which changes occur in each passage cross-section of the curved passage with the change in the shapes of the inner wall surface and the outer wall surface. This makes it possible to suppress situations in which pressure loss occurs in the fluid that flows through the curved passage, and to suppress reduction in the performance of the compressor.

In some examples, a distance between the inner wall surface and the outer wall surface in a direction perpendicular to the center line may be constant at any position along the center line. In this case, situations in which changes occur in the cross-sectional area of each passage cross-section of the curved passage can be suppressed. This makes it possible to suppress situations in which pressure loss occurs in the fluid that flows through the curved passage, and to suppress reduction in the performance of the compressor.

In some examples, in a cross-section perpendicular to the center line of the curved passage, the inner wall surface may extend linearly. The outer wall surface may be curved so as to expand from the inner wall surface in a direction opposite the inner wall surface. This facilitates die-casting with the direction from the outer wall surface toward the inner wall surface as a demolding direction.

In some examples, the interstage component may be an interstage housing coupled in series to the first housing via the second housing. The inner wall surface may be formed in the second housing. The outer wall surface may be formed in the interstage component. In this case, the forming of the interstage passage is facilitated by the simple operation of coupling the interstage housing, the second housing, and the first housing in series. Furthermore, the second housing and the interstage housing can be demolded by the inner wall surface and the outer wall surface being separately formed in the second housing and the interstage component in this way.

In some examples, the interstage component may be an interstage plate sandwiched between the first housing and the second housing. The inner wall surface may be formed in the interstage component. The outer wall surface may be formed in the first housing. In this case, the forming of the interstage passage is facilitated by utilizing the interstage plate between the first housing and the second housing. Furthermore, the interstage plate and the first housing can be demolded by the inner wall surface and the outer wall surface being separately formed in the interstage plate and the first housing in this way.

In some examples, the interstage passage may further include a linear passage extending linearly from the curved passage. The linear passage may include a first wall surface connected to the inner wall surface, and a second wall surface connected to the outer wall surface. The first wall surface and the second wall surface may extend parallel to each other in the cross-section passing through the center line, and may be formed in the impeller housing. In this case, the impeller housing in which a linear passage is formed can be demolded by setting the direction in which the linear passage extends as the demolding direction. Consequently, the components can be demolded even with such interstage passage that includes the curved passage and the linear passage.

Hereinafter, with reference to the drawings, the same elements or similar elements having the same function are denoted by the same reference numerals, and redundant description will be omitted.

An example compressor 1 illustrated in FIG. 1 is, for example, a series two-stage compressor. The compressor 1 includes a shaft 10, a compression device (or compression unit) 30, and a motor device (or motor unit) 50. The compression unit 30 has a first impeller 31, a second impeller 32, and an impeller housing 33. The first impeller 31 and the second impeller 32 are attached to one end portion of the shaft 10. The first impeller 31 and the second impeller 32 are, for example, disposed such that rear surfaces thereof face each other with a gap therebetween. The first impeller 31 is, for example, disposed coaxial with the second impeller 32. The first impeller 31 is, for example, positioned between the second impeller 32 and the motor unit 50.

The impeller housing 33 has a first housing 41 that accommodates the first impeller 31, and a second housing 42 that accommodates the second impeller 32. The second housing 42 is connected in series to the first housing 41 in an axial direction D1 in which the shaft 10 extends. The first impeller 31 and the first housing 41 form a low pressure-side compression stage that intakes and compresses a fluid R. The second impeller 32 and the second housing 42 form a high pressure-side compression stage that further compresses the fluid R compressed by the low pressure-side compression stage.

The compression unit 30 further has an interstage plate 43 and an interstage housing 44. The interstage plate 43 and the interstage housing 44 may each be considered an interstage component coupled to the impeller housing 33. The interstage plate 43 and the interstage housing 44 form, together with the impeller housing 33, an interstage passage 60 that introduces the fluid R from the first impeller 31 of the low pressure-side compression stage into the second impeller 32 of the high pressure-side compression stage. The interstage plate 43 is a plate-like component sandwiched between the first housing 41 and the second housing 42. The interstage housing 44 is a housing component that is coupled to the second housing 42 on the opposite side from the first housing 41 in the axial direction D1. The interstage housing 44 is coupled in series to the first housing 41 via the second housing 42 and the interstage plate 43 in the axial direction D1. Consequently, the interstage housing 44, the second housing 42, the interstage plate 43, and the first housing 41 are coupled in series to each other in the axial direction D1. The configurations being coupled in series in the axial direction D1 refers to the configurations being arranged in the axial direction D1, and each configuration having a connecting surface that intersects with the axial direction D1. Namely, the first housing (or first impeller housing) 41, the interstage plate 43, the second housing (or second impeller housing) 42 and the interstage housing 44 are arranged in the axial direction D1, with the second housing 42 interposed between the first housing 41 and the interstage housing 44, and with the interstage plate 43 interposed between the first housing 41 and the second housing 42. In some examples, the interstage plate 43, the first housing 41, and the second housing 42 are members that are separately provided. That is, the interstage plate 43, the first housing 41, and the second housing 42 are separate and independent components. The interstage plate 43, the first housing 41, and the second housing 42 are integrated to form the compression unit 30. A fastener(s) such as screws or bolts and nuts, or a bonding operation such as welding or meltbonding may be used for integrating or joining together the interstage plate 43, the first housing 41, and the second housing 42.

The motor unit 50 has an electric motor 51 and a motor housing 52. The electric motor 51 is a drive source for driving the compression unit 30. The electric motor 51 is attached to the other end portion of the shaft 10. The shaft 10 is rotatably supported by a bearing inside the motor housing 52. The motor housing 52 accommodates the electric motor 51. The motor housing 52 is coupled in series to the first housing 41 in the axial direction D1. The motor housing 52, the first housing 41, the interstage plate 43, the second housing 42, and the interstage housing 44 are separate and independent components, which are combined to form the housing of the compressor 1.

Figure 2:
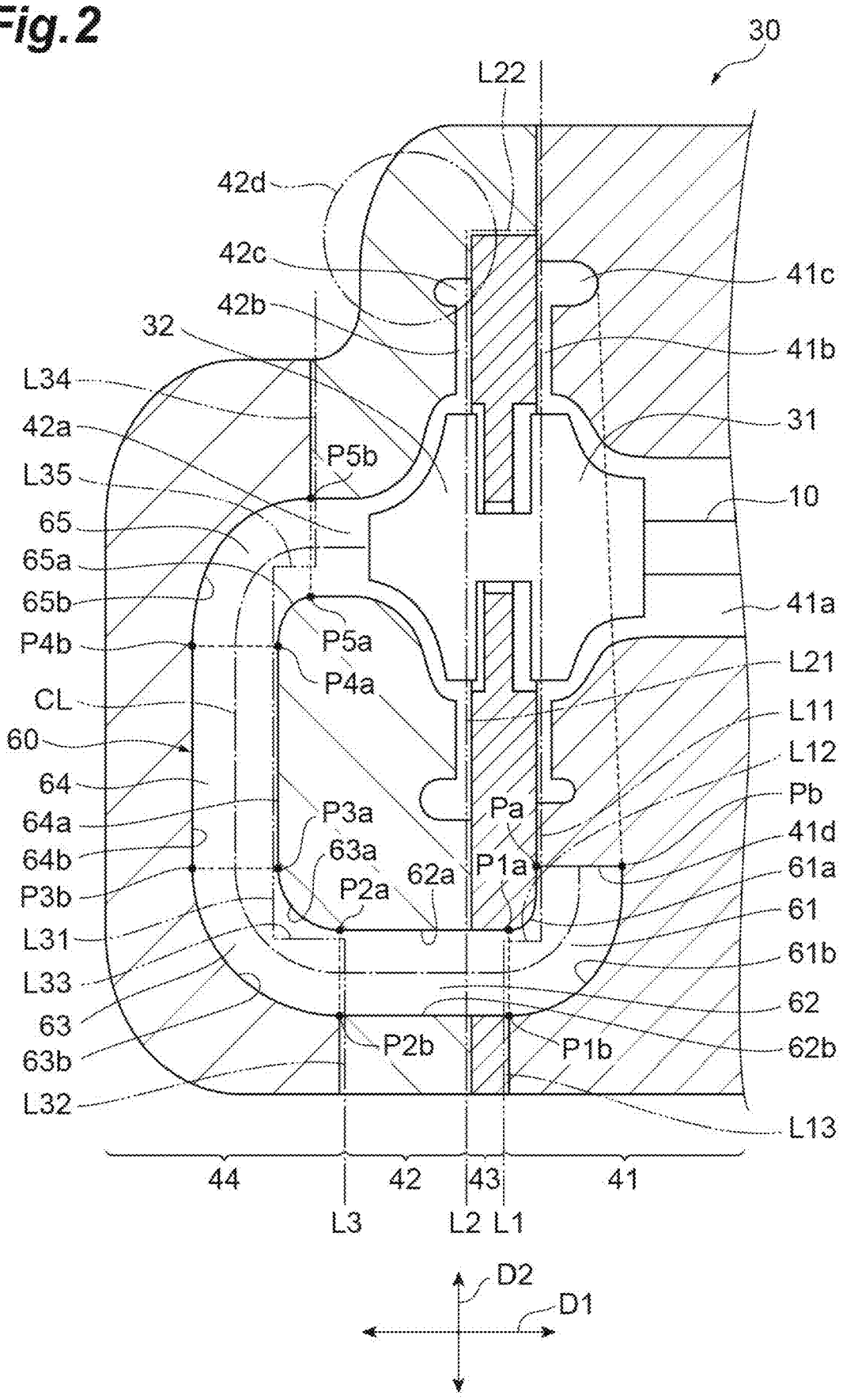
FIG. 2 is an enlarged cross-sectional view of an example compression device of the example compressor of FIG. 1.

FIG. 2 illustrates an enlargement of the compression unit 30. As illustrated in FIG. 2, the first housing 41 includes an inlet 41*a*, a diffuser passage 41*b*, and a scroll passage 41*c*. The inlet 41*a* is an opening that is coaxial with the shaft 10, and communicates with the inside of the motor housing 52 (see FIG. 1). The fluid R that is sucked in from an inlet of the motor housing 52 flows into the inlet 41*a*. The first impeller 31 is disposed inward of the inlet 41*a*. Speed energy is applied to the fluid R by rotation of the first impeller 31. The scroll passage 41*c* is formed so as to surround the first impeller 31. The diffuser passage 41*b* is formed between the first impeller 31 and the scroll passage 41*c*. The diffuser passage 41*b* compresses the fluid R by converting the speed energy applied to the fluid R into compression energy. The scroll passage 41*c* discharges the fluid R compressed by the diffuser passage 41*b*.

The second housing 42 includes an inlet 42*a*, a diffuser passage 42*b*, a scroll passage 42*c*, and an outlet 42*d*. The inlet 42*a* is an opening that is coaxial with the inlet 41*a* of the first housing 41, and faces away from the inlet 41*a*. The inlet 42*a* is connected to the scroll passage 41*c* of the first housing 41 via the interstage passage 60. The fluid R from the scroll passage 41*c* thus flows into the inlet 42*a* via the interstage passage 60. The second impeller 32 is disposed inward of the inlet 42*a*. Speed energy is applied to the fluid R by rotation of the second impeller 32. The scroll passage 42*c* is formed so as to surround the second impeller 32. The diffuser passage 42*b* is formed between the second impeller 32 and the scroll passage 42*c*. The diffuser passage 42*b* further compresses the fluid R by converting the speed energy applied to the fluid R into compression energy. The scroll passage 42*c* externally discharges the compressed fluid R from the outlet 42*d*.

The configuration of the interstage passage 60 will next be described in detail. In the following description, "above" and "upward" refer to an upper side in a vertical direction D2 when the compressor 1 is installed in a location of use, and "below" and "downward" refer to a lower side in the vertical direction D2. In some examples, the shaft 10 is disposed so as to extend in a horizontal direction when the compressor 1 is installed in a location of use. Consequently, the axial direction D1 is perpendicular to the vertical direction D2 in some examples.

The interstage passage 60 includes, for example, a curved passage 61, a linear passage 62, a curved passage 63, a linear passage 64, and a curved passage 65. These passages are formed on the same plane. That is, a center line CL of these passages are included in the same plane. The same plane here may, for example, be a plane along the axial direction D1 and the vertical direction D2. The center line CL of the interstage passage 60 may be a line that passes through the centroid of each passage cross-section perpendicular to a direction of extension of the interstage passage 60. FIG. 2 illustrates a cross-section of the compression unit 30 when the compression unit 30 is cut such that the cut passes through the center line CL in the plane along the axial direction D1 and the vertical direction D2. In some examples, the curved passage 61, the linear passage 62, the curved passage 63, the linear passage 64, and the curved passage 65 that form the interstage passage 60 are disposed in that order from upstream to downstream in a direction of flow of the fluid R that flows through the interstage passage 60.

The linear passage 62 is positioned below the second impeller 32, and extends in the axial direction D1. For example, the linear passage 62 extends parallel to the shaft 10. The curved passage 61 is positioned below the first impeller 31, and extends so as to be curved in an arc-shape between an exit 41*d* of the scroll passage 41*c* and the linear passage 62. That is, the curved passage 61 extends below the exit 41*d* of the scroll passage 41*c*, and is curved so as to connect to the linear passage 62 in the axial direction D1. The curved passage 63, the linear passage 64, and the curved passage 65 are positioned on a side of the second impeller 32 opposite that of the first impeller 31 in the axial direction D1.

The linear passage 64 extends linearly in the vertical direction D2 in a position above the linear passage 62 and below the shaft 10. The curved passage 63 is disposed on a side of the linear passage 62 opposite that of the curved passage 61 in the axial direction D1. The curved passage 63 extends so as to be curved in an arc-shape between the linear passage 62 and the linear passage 64. That is, the curved passage 63 extends upward from the linear passage 62, and is curved so as to connect to the linear passage 64. The curved passage 65 is disposed on a side of the linear passage 64 opposite that of the curved passage 63 in the vertical direction D2. The curved passage 65 extends so as to be curved in an arc-shape between the linear passage 64 and the inlet 42*a*. That is, the curved passage 65 extends above the linear passage 64, and is curved so as to connect to the inlet 42*a* in the axial direction D1.

The curved passage 61, the curved passage 63, and the curved passage 65, for example, have the same curvature. The curvature here may be based on the center line CL of each curved passage. In some examples, a "curved passage" refers to a passage that is a continuously curved portion of the interstage passage 60 represented by a curvature in the cross-section illustrated in FIG. 2. The curved passage 61, the curved passage 63, and the curved passage 65 may, for example, have different curvatures. The curved passage 61, the curved passage 63, and the curved passage 65 may be directly connected to each other, and not via a linear passage. As described further below, the curved passage 61, the curved passage 63, and the curved passage 65 of some examples are formed by the combination of the first housing 41, the interstage plate 43, the second housing 42, and the interstage housing 44. In some examples, the curved passage 61, the curved passage 63, and the curved passage 65 are formed only by curved portions in the cross-section illustrated in FIG. 2. However, the curved passage 61, the curved passage 63, and the curved passage 65 are not limited to the above described configuration, and may, for example, include a passage that extends linearly on a starting end or a terminal end, or between the starting end and the terminal end of each curved passage.

The configuration of each passage of the interstage passage 60 will now be described in detail. The curved passage 61 includes an inner wall surface 61*a* that forms the wall surface of the curved passage 61 on an inner side, and an outer wall surface 61*b* that forms the wall surface of the curved passage 61 on an outer side. In the cross-section illustrated in FIG. 2, the inner wall surface 61*a* and the outer wall surface 61*b* are represented as arc-shaped curves. The inner wall surface 61*a* is curved in an arc-shape in a position on the inner side, that is, in a position inward of the outer wall surface 61*b* in a radial direction. The outer wall surface 61*b* is curved in an arc-shape in a position on the outer side, that is, in a position outward of the inner wall surface 61*a* in the radial direction.

The outer wall surface 61*b* is, for example, disposed concentric with the inner wall surface 61*a*, and extends parallel to the inner wall surface 61*a*. The inner wall surface 61*a* may be a portion of the wall surface forming the curved passage 61 that at least includes the arc-shaped curved portion on the inner side illustrated in FIG. 2. The outer wall surface 61*b* may be a portion of the wall surface forming the curved passage 61 that at least includes the arc-shaped curved portion on the outer side illustrated in FIG. 2. The outer wall surface 61*b* may be the portion excluding the inner wall surface 61*a*. A starting end Pa of the inner wall surface 61*a* and a starting end Pb of the outer wall surface 61*b* are connected to the wall surface that forms the exit 41*d* of the scroll passage 41*c*. A starting end of a wall surface herein refers to one end of the wall surface that is positioned upstream in the direction of flow of the fluid R that flows through the interstage passage 60 in the cross-section illustrated in FIG. 2. A terminal end of a wall surface refers to the other end of the wall surface that is positioned downstream in the direction of flow.

The curved passage 63 includes an inner wall surface 63*a* that forms the wall surface of the curved passage 63 on the inner side, and an outer wall surface 63*b* that forms the wall surface of the curved passage 63 on the outer side. In the cross-section illustrated in FIG. 2, the inner wall surface 63*a* and the outer wall surface 63*b* are represented as arc-shaped curves. The inner wall surface 63*a* is curved in an arc-shape in a position on the inner side, that is, in a position inward of the outer wall surface 63*b* in the radial direction. The outer wall surface 63*b* is curved in an arc-shape in a position on the outer side, that is, in a position outward of the inner wall surface 63*a* in the radial direction. The outer wall surface 63*b* is disposed concentric with the inner wall surface 63*a*, and extends parallel to the inner wall surface 63*a*. The inner wall surface 63*a* may be a portion of the wall surface forming the curved passage 63 that at least includes the arc-shaped curved portion on the inner side illustrated in FIG. 2. The outer wall surface 63*b* may be a portion of the wall surface forming the curved passage 63 that at least includes the arc-shaped curved portion on the outer side illustrated in FIG. 2. The outer wall surface 63*b* may be the portion excluding the inner wall surface 63*a*.

The curved passage 65 includes an inner wall surface 65*a* that forms the wall surface of the curved passage 65 on the inner side, and an outer wall surface 65*b* that forms the wall surface of the curved passage 65 on the outer side. In the cross-section illustrated in FIG. 2, the inner wall surface 65*a* and the outer wall surface 65*b* are represented as arc-shaped curves. The inner wall surface 65*a* is curved in an arc-shape in a position on the inner side, that is, in a position inward of the outer wall surface 65*b* in the radial direction. The outer wall surface 65*b* is curved in an arc-shape in a position on the outer side, that is, in a position outward of the inner wall surface 65*a* in the radial direction. The outer wall surface 65*b* is disposed concentric with the inner wall surface 65*a*, and extends parallel to the inner wall surface 65*a*. The inner wall surface 65*a* may be a portion of the wall surface forming the curved passage 65 that at least includes the arc-shaped curved portion on the inner side illustrated in FIG. 2. The outer wall surface 65*b* may be a portion of the wall surface forming the curved passage 65 that at least includes the arc-shaped curved portion on the outer side illustrated in FIG. 2. The outer wall surface 65*b* may be a portion of the wall surface excluding the inner wall surface 65*a*. A terminal end P5*a* of the inner wall surface 65*a* and a terminal end P5*b* of the outer wall surface 65*b* are connected to the wall surface that forms the inlet 42*a*.

The linear passage 62 includes a first wall surface 62*a* that is connected to a terminal end P1*a* of the inner wall surface 61*a* and a starting end P2*a* of the inner wall surface 63*a* in the axial direction D1, and a second wall surface 62*b* that is connected to a terminal end P1*b* of the outer wall surface 61*b* and a starting end P2*b* of the outer wall surface 63*b* in the axial direction D1. In the cross-section illustrated in FIG. 2, the first wall surface 62*a* and the second wall surface 62*b* are represented as straight lines extending parallel to each other in the axial direction D1. The first wall surface 62*a* may be a portion of the wall surface forming the linear passage 62 that corresponds to the inner wall surface 61*a* and the inner wall surface 63*a*. The second wall surface 62*b* may be a portion of the wall surface forming the linear passage 62 that corresponds to the outer wall surface 61*b* and the outer wall surface 63*b*. The second wall surface 62*b* may be a portion of the wall surface excluding the first wall surface 62*a*.

The linear passage 64 includes a first wall surface 64*a* that is connected to a terminal end P3*a* of the inner wall surface 63*a* and a starting end P4*a* of the inner wall surface 65*a* in the vertical direction D2, and a second wall surface 64*b* that is connected to a terminal end P3*b* of the outer wall surface 63*b* and a starting end P4*b* of the outer wall surface 65*b* in the vertical direction D2. In the cross-section illustrated in FIG. 2, the first wall surface 64*a* and the second wall surface 64*b* are represented as straight lines extending parallel to each other in the vertical direction D2. The first wall surface 64*a* may be a portion of the wall surface forming the linear passage 64 that corresponds to the inner wall surface 63*a* and the inner wall surface 65*a*. The second wall surface 64*b* may be a portion of the wall surface forming the linear passage 64 that corresponds to the outer wall surface 63*b* and the outer wall surface 65*b*. The second wall surface 64*b* may be a portion of the wall surface excluding the first wall surface 64*a*.

The area of each passage cross-section of the interstage passage 60 is, for example, constant. That is, the area of the passage cross-section of the interstage passage 60 at any position along the center line CL is set to be the same as the area of the passage cross-section of the interstage passage 60 at any other position along the center line CL. Namely, a transverse area of the interstage passage, taken orthogonally to the center line (or flow direction of the fluid) CL, is constant along an entire length of the interstage passage, including the curved passages 61, 63, 65. Consequently, the cross-sectional area of the linear passage 62, the cross-sectional area (or transverse area) of the linear passage 64, the cross-sectional area of the curved passage 61, the cross-sectional area of the curved passage 63, and the cross-sectional area of the curved passage 65 are the same. The cross-sectional areas of the passages being the same is not limited to cases in which the cross-sectional areas of the passages are exactly the same, and the cross-sectional areas of the passages may include a certain amount of allowable error. A certain amount of allowable error refers, for example, to an error in the cross-sectional areas of the passages within an acceptable range for pressure loss that occurs in the fluid R that flows through the passage.

Figure 3:
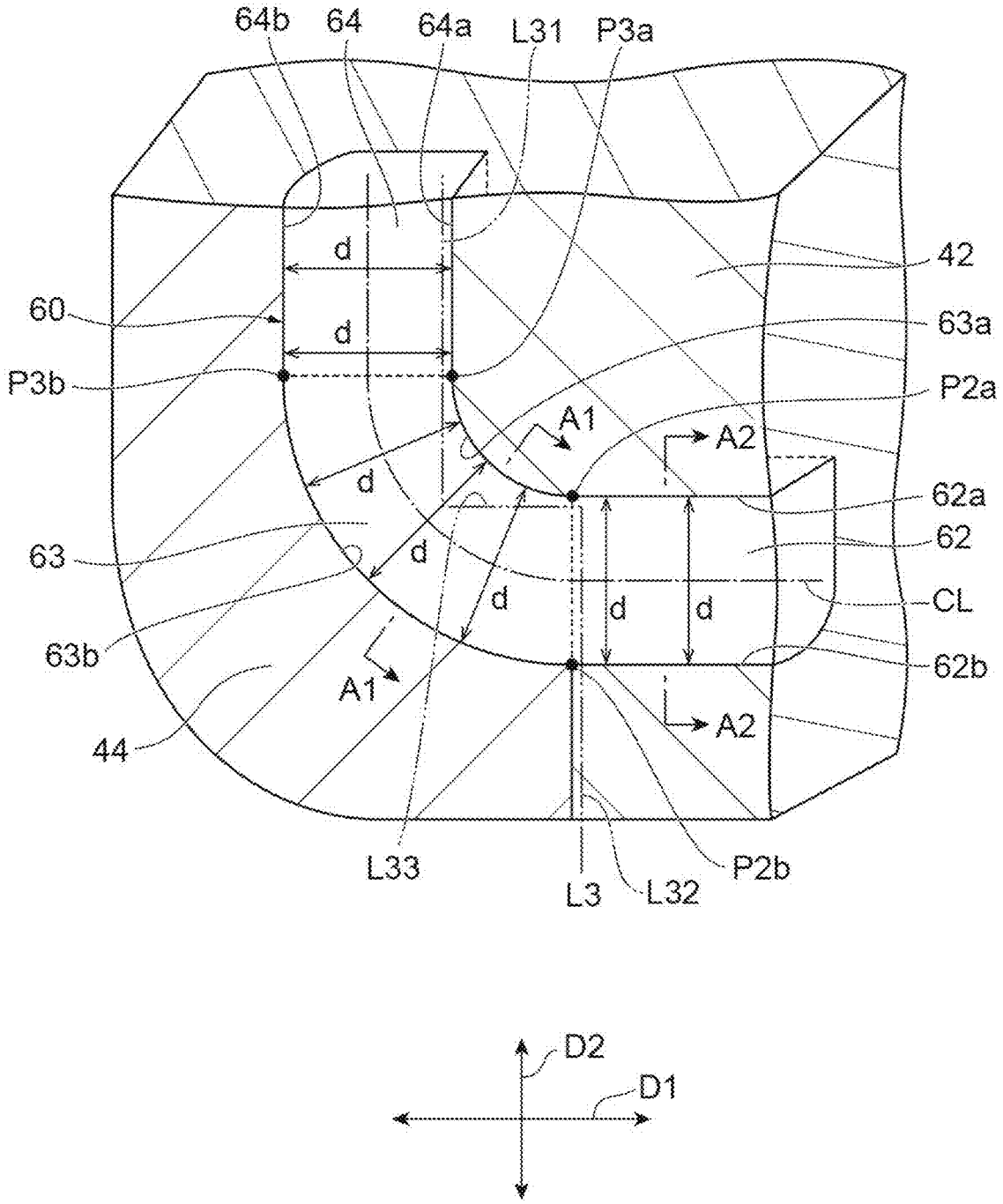
FIG. 3 is an enlarged cross-sectional view of a portion of an example interstage passage of the example compression device of FIG. 1.

FIG. 3 illustrates an enlargement of the vicinity of the curved passage 63 of the interstage passage 60. In the case in which the cross-sectional area (or transverse area) of the curved passage 63 is constant, the distance between the outer wall surface 63*b* and the inner wall surface 63*a* is a constant distance d at any position along a direction of extension of the center line CL. That is, the distance between the outer wall surface 63*b* and the inner wall surface 63*a* at any position along the center line CL is the same as the distance between the outer wall surface 63*b* and the inner wall surface 63*a* at any other position along the center line CL (i.e., constant distance d). Namely, the distance between the inner wall surface 63*a* and the outer wall surface 63*b* taken orthogonally to the center line (or flow direction) CL is constant along an entire length of the curved passage 63. The distance between the outer wall surface 63*b* and the inner wall surface 63*a* refers to the gap between the outer wall surface 63*b* and the inner wall surface 63*a* in a direction perpendicular to the center line CL in the cross-section illustrated in FIG. 3. The distance between the first wall surface (or inner wall surface) 62*a* and the second wall surface (or outer wall surface) 62*b* of the linear passage 62, the distance between the first wall surface (or inner wall surface) 64*a* and the second wall surface (or inner wall surface) 64*b* of the linear passage 64, the distance between the outer wall surface 61*b* and the inner wall surface 61*a* of the curved passage 61, and the distance between the outer wall surface 65*b* and the inner wall surface 65*a* of the curved passage 65 may also be the constant distance d at any position along the direction of extension of the center line CL.

Figure 4A:
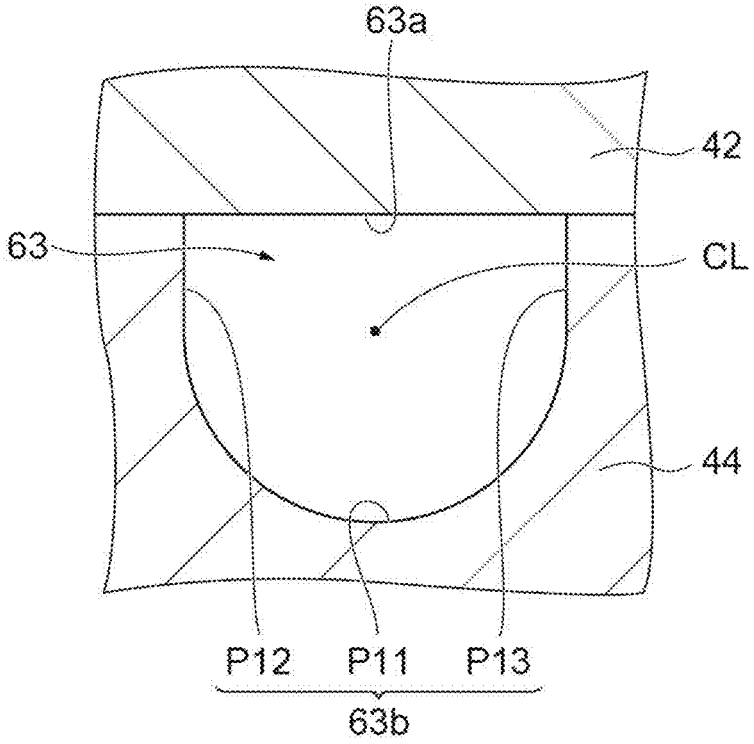
FIG. 4A is a cross-sectional view of the example interstage passage taken along line A1-A1 of FIG. 3.

The shapes of the passage cross-sections of the interstage passage 60 are, for example, the same. FIG. 4A illustrates a cross-sectional shape of the curved passage 63 in a plane perpendicular to the center line CL. As illustrated in FIG. 4A, the cross-sectional shape of the curved passage 63 is not circular, but U-shaped. The inner wall surface 63*a* that forms the curved passage 63 extends linearly in the cross-section illustrated in FIG. 4A. Consequently, the inner wall surface 63*a* forms a plane that extends in a direction along the center line CL and the direction perpendicular to the center line CL. The outer wall surface 63*b* is curved so as to expand away from the inner wall surface 63*a* in the cross-section illustrated in FIG. 4A. Consequently, the outer wall surface 63*b* forms a curved plane that extends along the direction along the center line CL and is curved in the direction perpendicular to the center line CL.

The outer wall surface 63*b* includes, in the cross-section illustrated in FIG. 4A, an arc-shaped curved portion P11 that is curved so as to expand away from the inner wall surface 63*a*, and a pair of linear portions P12, P13 that connect the curved portion P11 to the inner wall surface 63*a*. Namely, in the transverse cross-section of FIG. 4A that is taken orthogonally to the center line (or flow direction) CL of the curved passage 63, the inner wall surface 63*a* extends linearly, and the outer wall surface 63*b* is curved convexly relative to the inner wall surface 63*a*. The pair of linear portions P12, P13 extend linearly in a direction perpendicular to the inner wall surface 63*a* from respective ends of the inner wall surface 63*a*, and are connected to respective ends of the curved portion P11. The pair of linear portions P12, P13, for example, extend parallel to each other. The curved passage 61 and the curved passage 65 also have the same cross-sectional shape as the curved passage 63.

Figure 4B:
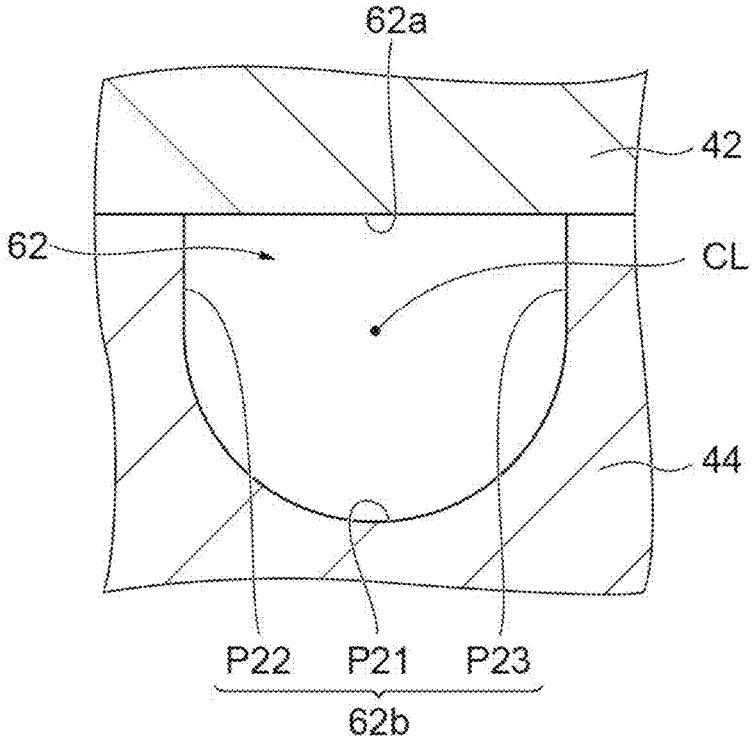
FIG. 4B is a cross-sectional view of the example interstage passage taken along line A2-A2 of FIG. 3.

FIG. 4B illustrates a cross-sectional shape of the linear passage 62 in the plane perpendicular to the center line CL. As illustrated in FIG. 4B, the linear passage 62, for example, has the same cross-sectional shape as the curved passage 63. The first wall surface 62*a* that forms the linear passage 62 extends linearly in the cross-section illustrated in FIG. 4B. Consequently, the first wall surface 62*a* forms a plane that extends in the direction along the center line CL and the direction perpendicular to the center line CL, similarly to the inner wall surface 63*a*. The second wall surface 62*b* is curved so as to expand away from the first wall surface 62*a* in the cross-section illustrated in FIG. 4B. Consequently, the second wall surface 62*b* forms a curved plane that extends along the direction along the center line CL and is curved in the direction perpendicular to the center line CL, similarly to the outer wall surface 63*b*.

The second wall surface 62*b* includes, in the cross-section illustrated in FIG. 4B, an arc-shaped curved portion P21 that is curved so as to expand away from the first wall surface 62*a*, and a pair of linear portions P22, P23 that connect the curved portion P21 to the first wall surface 62*a*. The pair of linear portions P22, P23 extend linearly in a direction perpendicular to the first wall surface 62*a* from respective ends of the first wall surface 62*a*, and are connected to respective ends of the curved portion P21. The pair of linear portions P22, P23, for example, extend parallel to each other. The linear passage 64 also has the same cross-sectional shape as the linear passage 62.

As described above, the interstage passage 60 having the configuration above is formed by the combination of the first housing 41, the interstage plate 43, the second housing 42, and the interstage housing 44. That is, the wall surface that forms the interstage passage 60 is separately formed in the first housing 41, the interstage plate 43, the second housing 42, and the interstage housing 44. The cross-section illustrated in FIG. 2 shows border lines L1, L2, L3 indicating the boundaries between the first housing 41, the interstage plate 43, the second housing 42, and the interstage housing 44. The border line L1 indicates the boundary between the first housing 41 and the interstage plate 43. The border line L2 indicates the boundary between the interstage plate 43 and the second housing 42. The border line L3 indicates the boundary between the second housing 42 and the interstage housing 44.

The border line L1 extends in the vertical direction D2 so as to pass through the curved passage 61 of the interstage passage 60. The border line L1 includes a border line L11, a border line L12, and a border line L13. The border line L11 extends in the vertical direction D2 between the starting end Pa of the inner wall surface 61*a* and the starting end Pb of the outer wall surface 61*b*. For example, the border line L11 extends in the vertical direction D2 so as to be in contact with the starting end Pa of the inner wall surface 61*a*. The border line L11 passes through the scroll passage 41*c*. A lower end of the border line L11 is, for example, positioned between the inner wall surface 61*a* and the center line CL.

The border line L13 extends in the vertical direction D2 below the border line L11 in a position offset from the border line L11 in the axial direction D1. The border line L13, for example, extends in the vertical direction D2 so as to be in contact with the terminal end P1*b* of the outer wall surface 61*b*, or so as to pass through the terminal end P1*b*. An upper end of the border line L13 is, for example, in the same position as the lower end of the border line L11 in the vertical direction D2. The border line L12 connects the lower end of the border line L11 to the upper end of the border line L13 in the axial direction D1. The border line L12 extends in the axial direction D1 between the terminal end Pia of the inner wall surface 61*a* and the terminal end P1*b* of the outer wall surface 61*b*, more specifically, between the terminal end P1*a* of the inner wall surface 61*a* and the center line CL. The border line L12 may, for example, extend in the axial direction D1 so as to be in contact with the terminal end P1*a* of the inner wall surface 61*a*. Accordingly, the border lines L11 and L13 intersect the axial direction D1 and the border line L12 which extends from the border line L11 to the border line L13, intersects the vertical direction D2, with the starting end Pa of the inner wall surface 61*a* facing the starting end Pb of the outer wall surface 61*b* in the axial direction D1 and the terminal end P1*a* of the inner wall surface 61*a* facing the terminal end P1*b* of the outer wall surface 61*b* in the vertical direction D2. As a result of such border line L1 being set, the entirety of the inner wall surface 61*a* from the starting end Pa to the terminal end P1*a* is disposed on one side of the border line L1. The entirety of the outer wall surface 61*b* from the starting end Pb to the terminal end P1*b* is disposed on the other side of the border line L1.

The border line L2 is positioned between the border line L1 and the border line L3, and extends in the vertical direction D2 so as to pass through the linear passage 62 of the interstage passage 60. The border line L2 includes a border line L21 and a border line L22. The border line L21 extends parallel to the border line L11 and the border line L13 with gaps therebetween. The border line L21 extends in the vertical direction D2 so as to pass through the scroll passage 42*c*. The border line L22 extends in the axial direction D1 from an upper end of the border line L21, and is connected to the border line L11 of the border line L1.

The border line L3 extends in the vertical direction D2 so as to pass through the curved passage 63 and the curved passage 65 of the interstage passage 60. The border line L3 includes a border line L31 (first border line), a border line L32 (second border line), a border line L33, a border line L34, and a border line L35. The border line L31 extends in the vertical direction D2 between the terminal end P3*a* of the inner wall surface 63*a* and the terminal end P3*b* of the outer wall surface 63*b*. For example, the border line L31 extends in the vertical direction D2 so as to be in contact with the terminal end P3*a* of the inner wall surface 63*a*. A lower end of the border line L31 is, for example, positioned between the inner wall surface 63*a* and the center line CL. The border line L31 extends in the vertical direction D2 between the starting end P4*a* of the inner wall surface 65*a* and the starting end P4*b* of the outer wall surface 65*b*. For example, the border line L31 extends in the vertical direction D2 so as to be in contact with the starting end P4*a* of the inner wall surface 65*a*. An upper end of the border line L31 is, for example, positioned between the inner wall surface 65*a* and the center line CL.

The border line L32 extends in the vertical direction D2 below the border line L31 in a position offset from the border line L31 toward the borderline L2 in the axial direction D1. The borderline L32, for example, extends in the vertical direction D2 so as to be in contact with the starting end P2*b* of the outer wall surface 63*b*, or so as to pass through the starting end P2*b*. An upper end of the border line L32 is, for example, in the same position as the lower end of the border line L31 in the vertical direction D2. The border line L33 connects the lower end of the border line L31 to the upper end of the border line L32 in the axial direction D1. The border line L33 extends in the axial direction D1 between the starting end P2*a* of the inner wall surface 63*a* and the starting end P2*b* of the outer wall surface 63*b*, more specifically, between the starting end P2*a* of the inner wall surface 63*a* and the center line CL. The border line L33 may, for example, extend in the axial direction D1 so as to be in contact with the starting end P2*a* of the inner wall surface 63*a*. With reference to the cross-sectional view of FIG. 3, the curved passage 63 has a first end P2*a*, P2*b* that is oriented to direct the fluid in the axial direction (or first direction) D1, and a second end P3*a*, P3*b* that is oriented to direct the fluid in the vertical direction (or second direction) D2. The inner wall surface (or first wall surface) 63*a* is formed by the second impeller housing (or inner component) 42 along the curved passage 63, and the outer wall surface (or second wall surface) 63*b* is formed by the interstage component (or outer component) 44 along the curved passage 63. The second impeller housing (or inner component) 42 also forms a part of the outer wall 62*b* along the linear passage 62, and contacts the interstage housing (or outer component) 44 at a first position P2*b* (corresponding to the starting end P2*b*) along the outer wall surface 63*b*. The first position P2*b* is offset in the axial direction D1 from a second position P3*a* (corresponding to the terminal end P3*a*) located on the inner wall surface 63*a* at the second end P3*a*, P3*b* of the curved passage 63. In addition, the outer wall surface 63*b* faces the inner wall surface 63*a* in the vertical direction D2 at the first position P2*b*. The first position P2*b* along the outer wall surface 63*b* where the interstage housing 44 contacts the second impeller housing 42, is located at the first end P2*a*, P2*b* of the curved passage 63, from which the linear passage 62 extends in the axial direction. In FIG. 3, the linear passage 64 extends from the second end P3*a*, P3*b* of the curved passage 63 in the vertical direction D2, and the interstage housing 44 contacts the impeller housing 42 along the border line L32 from the first position P2*b*. Accordingly, the border line L32 is offset in the axial direction D1, from the inner wall surface 64*a* of the linear passage 62. Additionally, a first width of the second impeller housing 42 taken in the axial direction D1 at the second end P3*a*, P3*b* of the curved passage 63 (from the border line L31 to the border line L21 with reference to FIG. 2), is greater than a second width of the second impeller housing 42 taken in the axial direction D1 along the outer wall surface 62*b* formed by the second impeller housing 42 (from the first position P2*b* to the border line L21 with reference to FIG. 2). Consequently, the second impeller housing (or first component) 42 forms the inner wall surface 63*a* along an entire length of the curved passage 63, and the interstage housing (or second component) 44 forms the outer wall surface 63*b* along the entire length of the curved passage 63. With reference FIG. 2, along the example curved passage 61, the outer wall surface (or first wall surface) 61*b* is formed by the first impeller housing (or outer component) 41, and the inner wall surface (or second wall surface) 61*a* is formed by the interstage plate (or inner component) 43.

The border line L34 extends in the vertical direction D2 above the border line L31 in a position offset from the border line L31 toward the borderline L2 in the axial direction D1. The borderline L34, for example, extends in the vertical direction D2 so as to be in contact with the terminal end P5*b* of the outer wall surface 65*b*, or so as to pass through the terminal end P5*b*. A lower end of the border line L34 is, for example, in the same position as the upper end of the border line L31 in the vertical direction D2. The border line L35 connects the upper end of the border line L31 to the lower end of the border line L34 in the axial direction D1. The border line L35 extends in the axial direction D1 between the terminal end P5*a* of the inner wall surface 65*a* and the terminal end P5*b* of the outer wall surface 65*b*, more specifically, between the terminal end P5*a* of the inner wall surface 65*a* and the center line CL. The border line L35 may, for example, extend in the axial direction D1 so as to be in contact with the terminal end P5*a* of the inner wall surface 65*a*.

As a result of such border line L3 being set, the entirety of the inner wall surface 63*a* from the starting end P2*a* to the terminal end P3*a* is disposed on one side of the border line L3. The entirety of the outer wall surface 63*b* from the starting end P2*b* to the terminal end P3*b* is disposed on the other side of the border line L3. The entirety of the inner wall surface 65*a* from the starting end P4*a* to the terminal end P5*a* is disposed on the one side of the border line L3. The entirety of the outer wall surface 65*b* from the starting end P4*b* to the terminal end P5*b* is disposed on the other side of the border line L3.

Figure 5:
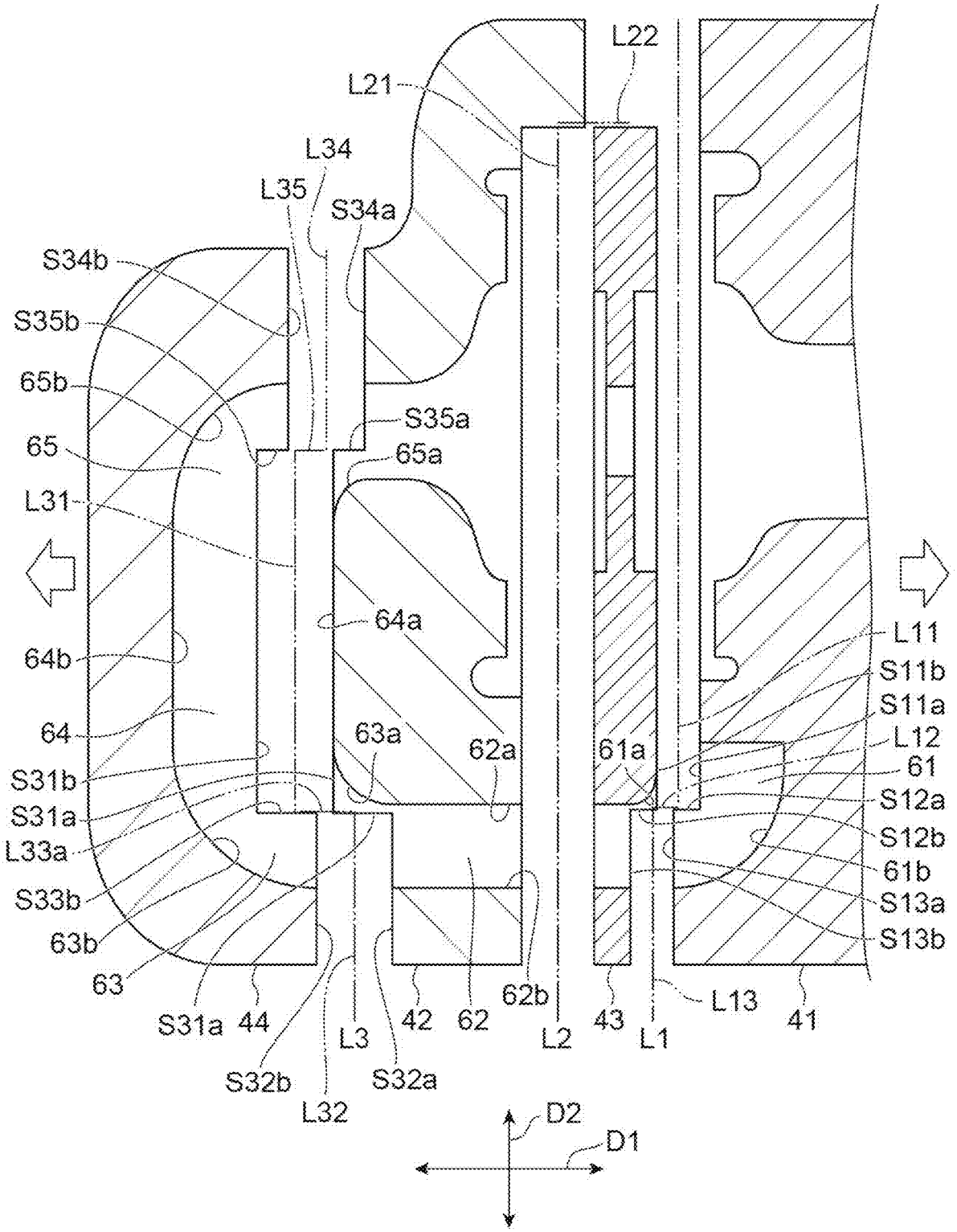
FIG. 5 is an exploded cross-sectional view of the example compression device of FIG. 2.

FIG. 5 illustrates the first housing 41, the interstage plate 43, the second housing 42, and the interstage housing 44 being divided from each other at the border lines L1, L2, L3. As illustrated in FIG. 5, the border line L1 that passes through the curved passage 61 divides the inner wall surface 61*a* and the outer wall surface 61*b* of the curved passage 61. As a result, the outer wall surface 61*b* (i.e., the entirety of the outer wall surface 61*b* from the starting end Pb to the terminal end P1*b*) positioned on one side of the border line L1 is formed in the first housing 41. The inner wall surface 61*a* (i.e., the entirety of the inner wall surface 61*a* from the starting end Pa to the terminal end P1*a*) positioned on the other side of the border line L1 is formed in the interstage plate 43. That is, the inner wall surface 61*a* and the outer wall surface 61*b* that form the wall surface of the curved passage 61 are separately formed in the interstage plate 43 and the first housing 41, respectively.

The first housing 41 includes divided surfaces S11*a*, S12*a*, and S13*a* that are formed by being divided at the border line L1. The divided surface S11*a* is a plane that is formed due to a division at the border line L11, and extends in the vertical direction D2 in the cross-section illustrated in FIG. 5. The divided surface S13*a* is a plane that is formed due to a division at the border line L13, and extends in the vertical direction D2 in the cross-section illustrated in FIG. 5. The divided surface S13*a* is, for example, offset toward the linear passage 62 in the axial direction D1 relative to the divided surface S11*a*. The divided surface S12*a* is a plane that is formed due to a division at the border line L12, and extends in the axial direction D1 in the cross-section illustrated in FIG. 5. The divided surface S12*a* connects the divided surface S11*a* to the divided surface S13*a* in the axial direction D1. The divided surface S12*a* is, for example, formed perpendicular to the divided surface S11*a* and the divided surface S13*a*.

The interstage plate 43 includes divided surfaces S11*b*, S12*b*, and S13*b* formed by being divided at the border line L1. The divided surface S11*b* is a plane that is formed due to the division at the border line L11, and extends in the vertical direction D2 in the cross-section illustrated in FIG. 5. The divided surface S11*b* extends parallel to the divided surface S11*a*. The divided surface S13*b* is a plane that is formed due to the division at the border line L13, and extends in the vertical direction D2 in the cross-section illustrated in FIG. 5. The divided surface S13*b* is, for example, offset toward the linear passage 62 in the axial direction D1 relative to the divided surface S11*b*. The divided surface S12*b* is a plane that is formed due to the division at the border line L12, and extends in the axial direction D1 in the cross-section illustrated in FIG. 5. The divided surface S12*b* connects the divided surface S11*b* to the divided surface S13*b* in the axial direction D1. The divided surface S12*b* is, for example, formed perpendicular to the divided surface S11*b* and the divided surface S13*b*.

The border line L3 that passes through the curved passage 63 and the curved passage 65 divides the inner wall surface 63*a* and the outer wall surface 63*b* of the curved passage 63 as well as the inner wall surface 65*a* and the outer wall surface 65*b* of the curved passage 65. As a result, the inner wall surface 63*a* (i.e., the entirety of the inner wall surface 63*a* from the starting end P2*a* to the terminal end P3*a*) and the inner wall surface 65*a* (i.e., the entirety of the inner wall surface 65*a* from the starting end P4*a* to the terminal end P5*a*) positioned on one side of the border line L3 are formed in the second housing 42. The outer wall surface 63*b* (i.e., the entirety of the outer wall surface 63*b* from the starting end P2*b* to the terminal end P3*b*) and the outer wall surface 65*b* (i.e., the entirety of the outer wall surface 65*b* from the starting end P4*b* to the terminal end P5*b*) positioned on the other side of the border line L3 are formed in the interstage housing 44. That is, the inner wall surface 63*a* and the outer wall surface 63*b* that form the wall surface of the curved passage 63 are separately formed in the second housing 42 and the interstage housing 44, respectively. The inner wall surface 65*a* and the outer wall surface 65*b* that form the wall surface of the curved passage 65 are separately formed in the second housing 42 and the interstage housing 44, respectively.

The second housing 42 includes divided surfaces S31*a*, S32*a*, S33*a*, S34*a*, and S35*a* that are formed by being divided at the border line L3. The divided surface S31*a* is a plane that is formed due to a division at the border line L31, and extends in the vertical direction D2 in the cross-section illustrated in FIG. 5. The divided surface S32*a* is a plane that is formed due to a division at the border line L32, and extends in the vertical direction D2 in the cross-section illustrated in FIG. 5. The divided surface S34*a* is a plane that is formed due to a division at the border line L34, and extends in the vertical direction D2 in the cross-section illustrated in FIG. 5. The divided surface S32*a* and the divided surface S34*a* are, for example, offset toward the linear passage 62 in the axial direction D1 relative to the divided surface S31*a*. The divided surface S32*a* is a plane that is formed due to a division at the border line L32, and extends in the axial direction D2 in the cross-section illustrated in FIG. 5. The divided surface S33*a* connects the divided surface S31*a* to the divided surface S32*a* in the axial direction D1. The divided surface S35*a* is a plane that is formed due to a division at the border line L35, and extends in the axial direction D1 in the cross-section illustrated in FIG. 5. The divided surface S35*a* connects the divided surface S31*a* to the divided surface S34*a* in the axial direction D1. The divided surface S32*a* and the divided surface S35*a* are, for example, formed perpendicular to the divided surface S31*a*, the divided surface S33*a*, and the divided surface S34*a*.

The interstage housing 44 includes divided surfaces S31*b*, S32*b*, S33*b*, S34*b*, and S35*b* formed by being divided at the border line L3. The divided surface S31*b* is a plane that is formed due to the division at the border line L31, and extends in the vertical direction D2 in the cross-section illustrated in FIG. 5. The divided surface S32*b* is a plane that is formed due to the division at the border line L32, and extends in the vertical direction D2 in the cross-section illustrated in FIG. 5. The divided surface S34*b* is a plane that is formed due to the division at the border line L34, and extends in the vertical direction D2 in the cross-section illustrated in FIG. 5. The divided surface S32*b* and the divided surface S34*b* are, for example, offset toward the linear passage 62 in the axial direction D1 relative to the divided surface S31*b*. The divided surface S32*b* is a plane that is formed due to the division at the border line L32, and extends in the axial direction D2 in the cross-section illustrated in FIG. 5. The divided surface S33*b* connects the divided surface S31*b* to the divided surface S32*b* in the axial direction D1. The divided surface S35*b* is a plane that is formed due to the division at the border line L35, and extends in the axial direction D1 in the cross-section illustrated in FIG. 5. The divided surface S35*b* connects the divided surface S31*b* to the divided surface S34*b* in the axial direction D1. The divided surface S33*b* and the divided surface S35*b* are, for example, formed perpendicular to the divided surface S31*b*, the divided surface S32*b*, and the divided surface S34*b*.

As a result of the inner wall surfaces and the outer wall surfaces that form the curved passages being formed in separate components as described above, the components (i.e., the first housing 41, the interstage plate 43, the second housing 42, and the interstage housing 44) that form the housing of the compression unit 30 are shaped so as to enable demolding with the axial direction D1 being a demolding direction. A mold herein refers, for example, to a mold for castings. An annular sealing member such as an O-ring may be installed in each of the components at connecting portions of the interstage passage 60. In this case, the occurrence of leakage of the fluid R that flows through the interstage passage 60 is suppressed.

<Operation and Effects>

Figure 6:
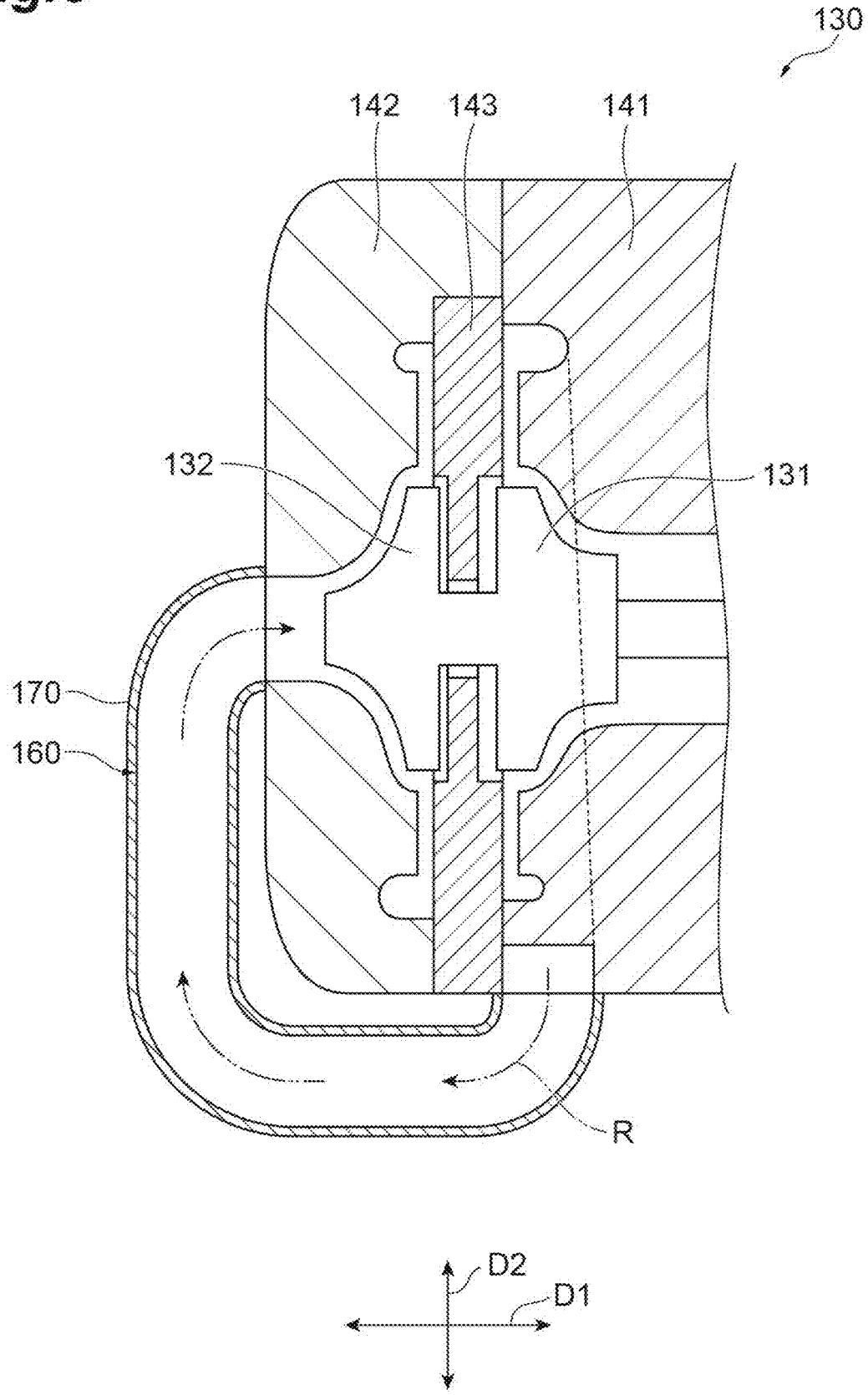
FIG. 6 is an enlarged cross-sectional view of a compression device according to a comparative example.

In a compression device (or compression unit) 130 of the compressor illustrated in FIG. 6, a first housing 141 that accommodates a first impeller 131 is connected to a second housing 142 that accommodates a second impeller 132 by a pipe 170. An interstage passage 160 that introduces the fluid R from the first impeller 131 into the second impeller 132 is formed inside the pipe 170. An interstage plate 143 is disposed between the first housing 141 and the second housing 142.

In such configuration in which the pipe 170 is connected to the first housing 141 and the second housing 142, there is the cost for the assembly man-hours of the pipe 170 in addition to the cost of the pipe 170 itself, so that mass production cost tends to be high. Consequently, it is difficult to improve the productivity of the compressor with the compression unit 130.

It can thus be contemplated to form such interstage passage in the housing of the compression unit. This enables the interstage passage to be formed without any pipes, so that the mass production cost can be suppressed. Additionally, the mass production cost can further be suppressed if the housing can be formed by die-casting, which has a low production cost. However, to form the housing by die-casting, it is necessary for the housing to be shaped to enable demolding. Taking into consideration the flow path of the fluid that passes through the interstage passage, there is a curved passage in one or more locations in the interstage passage that connects the low pressure-side compression stage to the high pressure-side compression stage. Such curved passage can be a factor that inhibits demolding of the housing.

Figure 7A:
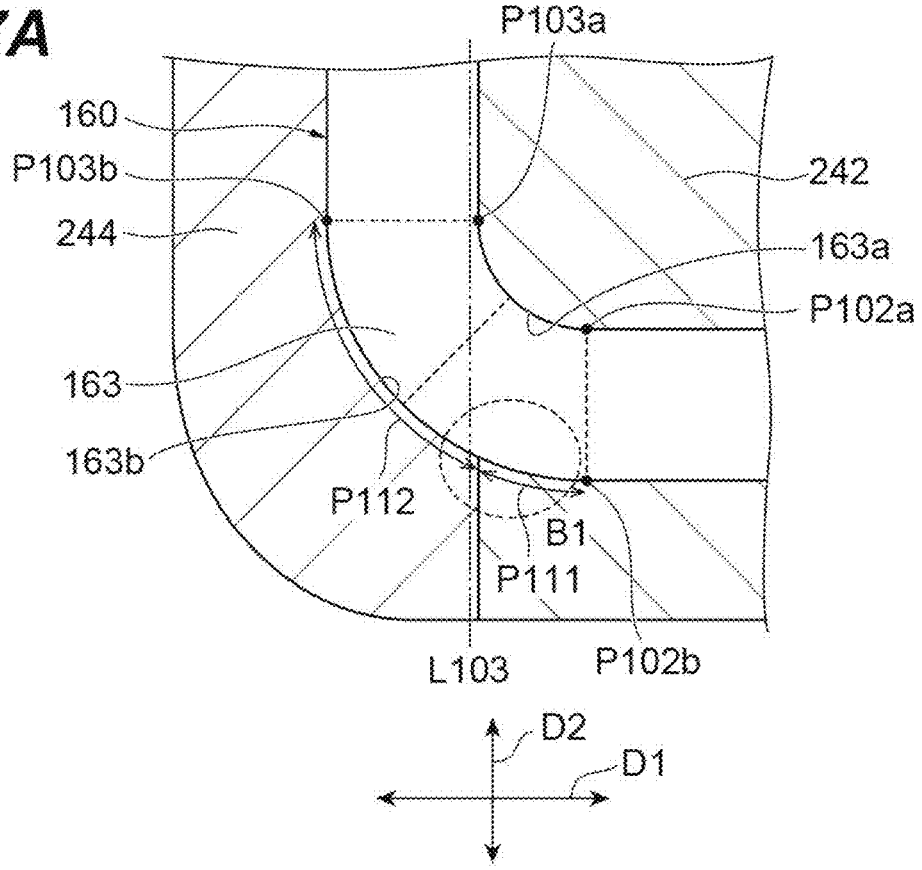
FIG. 7A is an enlarged cross-sectional view of a portion of a compression device according to Reference Example 1.

For example, FIG. 7A illustrates a configuration in which the interstage passage 160 having a curved passage 163 is formed inside the housing of the compression unit. In the case in which there is the curved passage 163, it can be contemplated to divide the housing into two components (e.g., a second housing 242 and an interstage housing 244) at a position passing through the curved passage 163 so that the housing is shaped to enable demolding. For example, in a case in which a border line L103 indicating the boundary between the second housing 242 and the interstage housing 244 is set so as to extend linearly in the vertical direction D2 between a terminal end P103*a* of an inner wall surface 163*a* and a terminal end P103*b* of an outer wall surface 163*b* of the curved passage 163, the border line L103 intersects with the outer wall surface 163*b*, and divides the outer wall surface 163*b* into a portion P111 and a portion P112. As a result, the portion P111 of the outer wall surface 163*b* and the inner wall surface 163*a* are formed in the same second housing 242. In this case, an overhanging portion B1 is formed in the portion P111, so that the second housing 242 cannot be demolded with the axial direction D1 as the demolding direction.

Figure 7B:
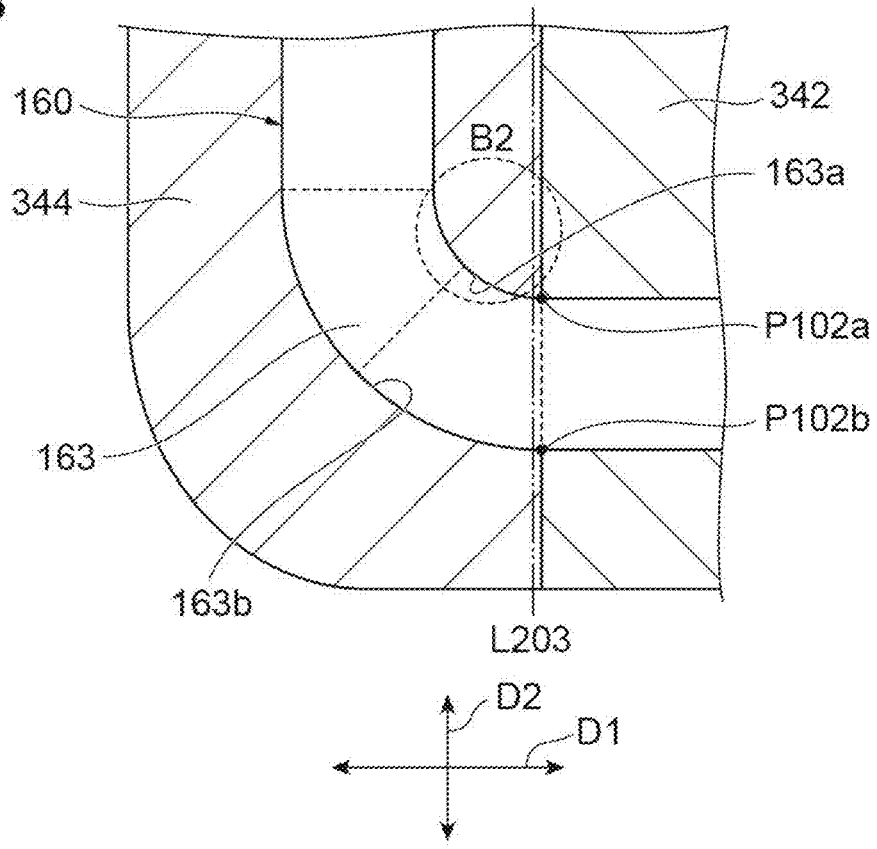
FIG. 7B is an enlarged cross-sectional view of a portion of a compression device according to Reference Example 2.

On the other hand, as illustrated in FIG. 7B, in a case in which a border line L203 indicating the boundary between a second housing 342 and an interstage housing 344 extends linearly in the vertical direction D2 so as to pass through a starting end P102*a* of the inner wall surface 163*a* and a starting end P102*b* of the outer wall surface 163*b* of the curved passage 163, the inner wall surface 163*a* and the outer wall surface 163*b* are formed in the same interstage housing 344. In this case, an overhanging portion B2 is formed in the inner wall surface 163*a*, so that the interstage housing 344 cannot be demolded with the axial direction D1 as the demolding direction. Consequently, the components cannot be formed by die-casting with the border lines L103, L203 illustrated in FIG. 7A and FIG. 7B.

Figure 8A:
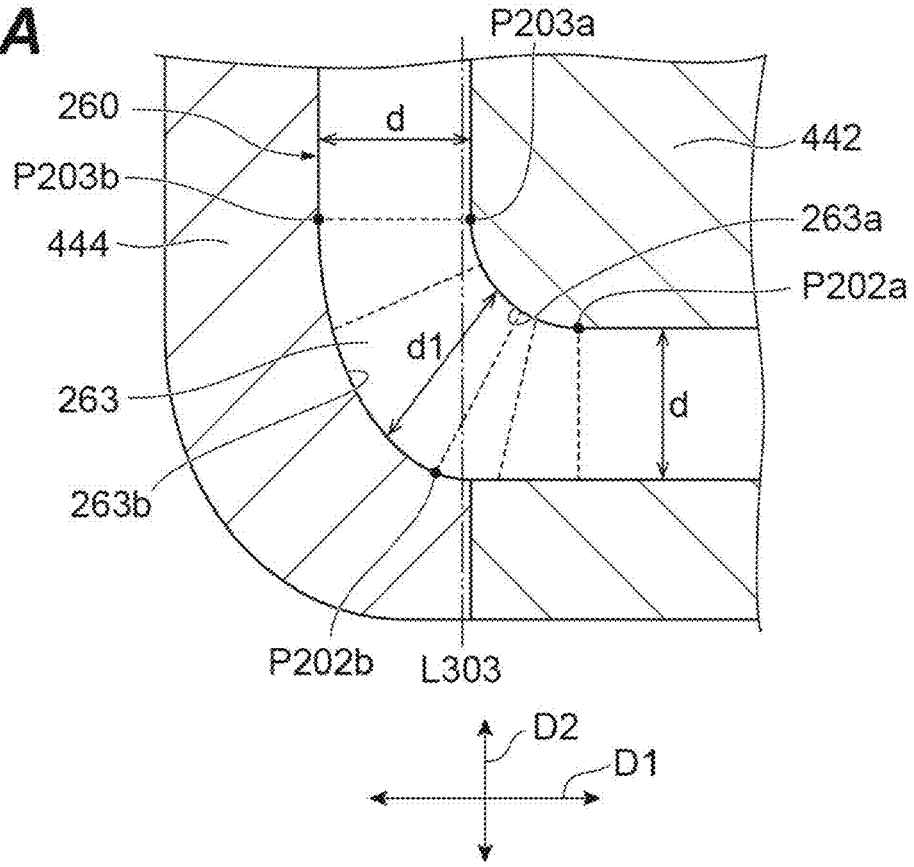
FIG. 8A is an enlarged cross-sectional view of a portion of a compression device according to Reference Example 3.

In contrast, as illustrated in FIG. 8A, it can be contemplated to set a border line L303 indicating the boundary between a second housing 442 and an interstage housing 444 in the same position as the border line L103 so as not to divide an outer wall surface 263*b* of a curved passage 263 by the border line L303. That is, it can be contemplated to adjust the shape (degree of curve, etc.) of the outer wall surface 263*b* such that the outer wall surface 263*b* does not extend beyond the border line L303. Specifically, it can be contemplated to adjust the position of a starting end P202*b* of the outer wall surface 263*b* such that it is on the same side as a terminal end P203*b* relative to the border line L303. In this case, the starting end P202*b* and the terminal end P203*b* of the outer wall surface 263*b* are positioned on one side of the border line L303, and a starting end P202*a* and a terminal end P203*a* of an inner wall surface 263*a* are positioned on the other side of the border line L303. That is, the inner wall surface 263*a* and the outer wall surface 263*b* are separately formed in the second housing 442 and the interstage housing 444.

Thus, unlike the case in which the inner wall surface 263*a* and the outer wall surface 263*b* are formed in one housing, no overhanging portions are formed in the second housing 442 or the interstage housing 444, so that the second housing 442 and the interstage housing 444 are both shaped to enable demolding. Consequently, in the example illustrated in FIG. 8A, the second housing 442 and the interstage housing 444 can be formed by die-casting. However, in this example, the distance between the outer wall surface 263*b* and the inner wall surface 263*a* is not the constant distance d, but a distance d1 that is greater than the distance d due to the adjustment of the shape of the outer wall surface 263*b*. In this case, changes occur in the cross-sectional area of the curved passage 263. Such changes in the cross-sectional area of the curved passage 263 can affect the flow of the fluid R that flows through the curved passage 263.

Figure 8B:
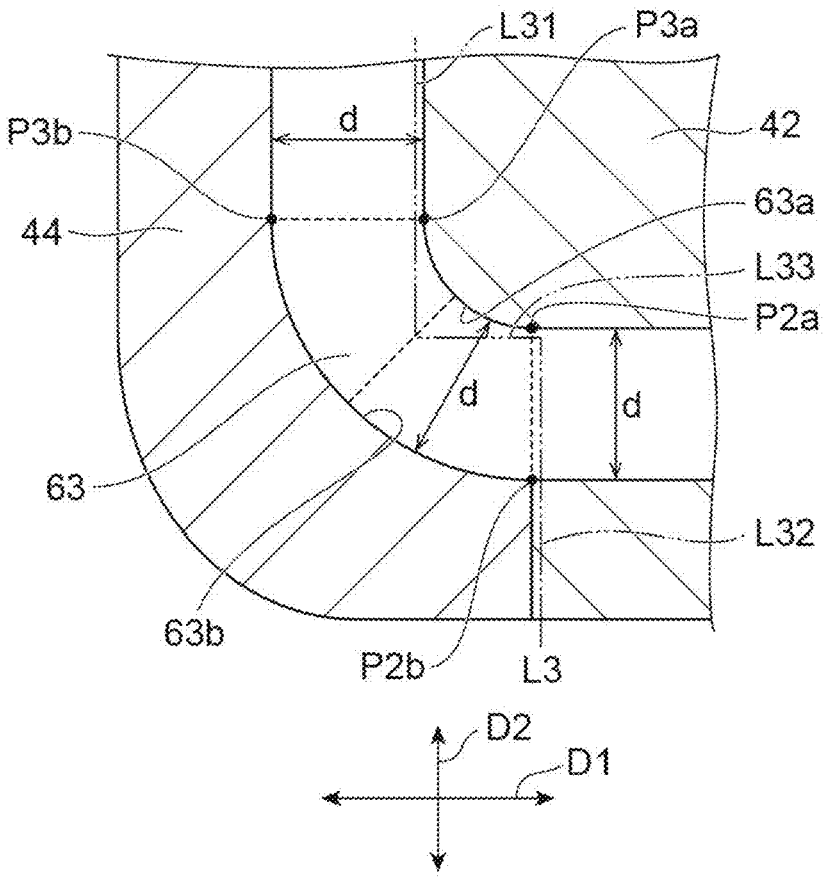
FIG. 8B is an enlarged cross-sectional view of a portion of a compression device according to Reference Example 4.

Thus, as illustrated in FIG. 8B, it can be contemplated to offset the border line L3 indicating the boundary between the second housing 42 and the interstage housing 44 in the axial direction D1. FIG. 8B illustrates the same configuration as the example compressor 1 described above. As described above, the border line L31 of the border line L3 extends in the vertical direction D2 between the terminal end P3*a* of the inner wall surface 63*a* and the terminal end P3*b* of the outer wall surface 63*b*. The border line L33 extends in the axial direction D1 between the starting end P2*a* of the inner wall surface 63*a* and the starting end P2*b* of the outer wall surface 63*b*, and is connected to the border line L31. The border line L32 extends downward from the border line L33. Dividing the second housing 42 and the interstage housing 44 by such border line L3 causes the inner wall surface 63*a* and the outer wall surface 63*b* to be separately formed in the second housing 42 and the interstage housing 44, similarly to the example illustrated in FIG. 8A. In this case, no overhanging portions are formed in the second housing 42 or the interstage housing 44, so that the second housing 42 and the interstage housing 44 are both shaped to enable demolding. As a result, the components of the compression unit 30 can be formed by die-casting, which has a low production cost, so that productivity can be improved. This makes it possible to suppress the mass production cost.

Furthermore, as illustrated in FIG. 8B, setting the border line L3 to be offset in the axial direction D1 eliminates the need to make adjustments such as changing the shape of the inner wall surface 63*a* or the outer wall surface 63*b* to match the border line L3. Consequently, the inner wall surface 63*a* and the outer wall surface 63*b* can be formed in different housings regardless of the shapes of the inner wall surface 63*a* and the outer wall surface 63*b*. As a result, it is possible to avoid the occurrence of situations in which changes occur in each passage cross-section of the curved passage 63 with the change in the shapes of the inner wall surface 63*a* and the outer wall surface 63*b*. That is, the distance between the inner wall surface 63*a* and the outer wall surface 63*b* can be kept at the constant distance d. This suppresses situations in which pressure loss occurs in the fluid R that flows through the curved passage 63, and suppresses reduction in the performance of the compressor 1.

In some of the examples described above, the inner wall surface 63*a* extends linearly and the outer wall surface 63*b* is curved so as to expand away from the inner wall surface 63*a* in a cross-section perpendicular to the center line CL of the curved passage 63. This configuration facilitates die-casting of the components with the direction from the outer wall surface 63*b* toward the inner wall surface 63*a* as the demolding direction.

In some of the examples described above, the interstage housing 44 is connected in series to the first housing 41 via the second housing 42 to form the interstage passage 60. This configuration facilitates the forming of the interstage passage 60 by the simple operation of connecting the interstage housing 44, the second housing 42, and the first housing 41 in series.

In some of the examples described above, the interstage plate 43 is interposed between the first housing 41 and the second housing 42 to form the interstage passage 60. This configuration facilitates the forming of the interstage passage 60 by utilizing the interstage plate 43.

In some of the examples described above, the linear passage 62 includes the first wall surface 62*a* and the second wall surface 62*b* that extend linearly and parallel to each other. The first wall surface 62*a* and the second wall surface 62*b* are formed in the second housing 42. This makes it possible to demold the second housing 42 with the axial direction D1 in which the linear passage 62 extends as the demolding direction. Consequently, the components can be demolded even with such interstage passage 60 that has the curved passage 63 and the linear passage 62.

Although in the examples described above, the configuration of the curved passage 63 of the interstage passage 60 has been mainly described, the other curved passages 61, 65 may be similarly described. The "curved passage" of the present disclosure may be viewed as any of the curved passages 61, 63, 65. Although in the examples described above, the case in which the "linear passage" of the present disclosure is applied to the linear passage 62 has been described, the "linear passage" of the present disclosure may be applied to the other linear passage 64. The "interstage passage" of the present disclosure has at least one curved passage, and it need not have a linear passage.

It is to be understood that not all aspects, advantages and features described herein may necessarily be achieved by, or included in, any one particular example. Indeed, having described and illustrated various examples herein, it should be apparent that other examples may be modified in arrangement and detail.

Figure 9:
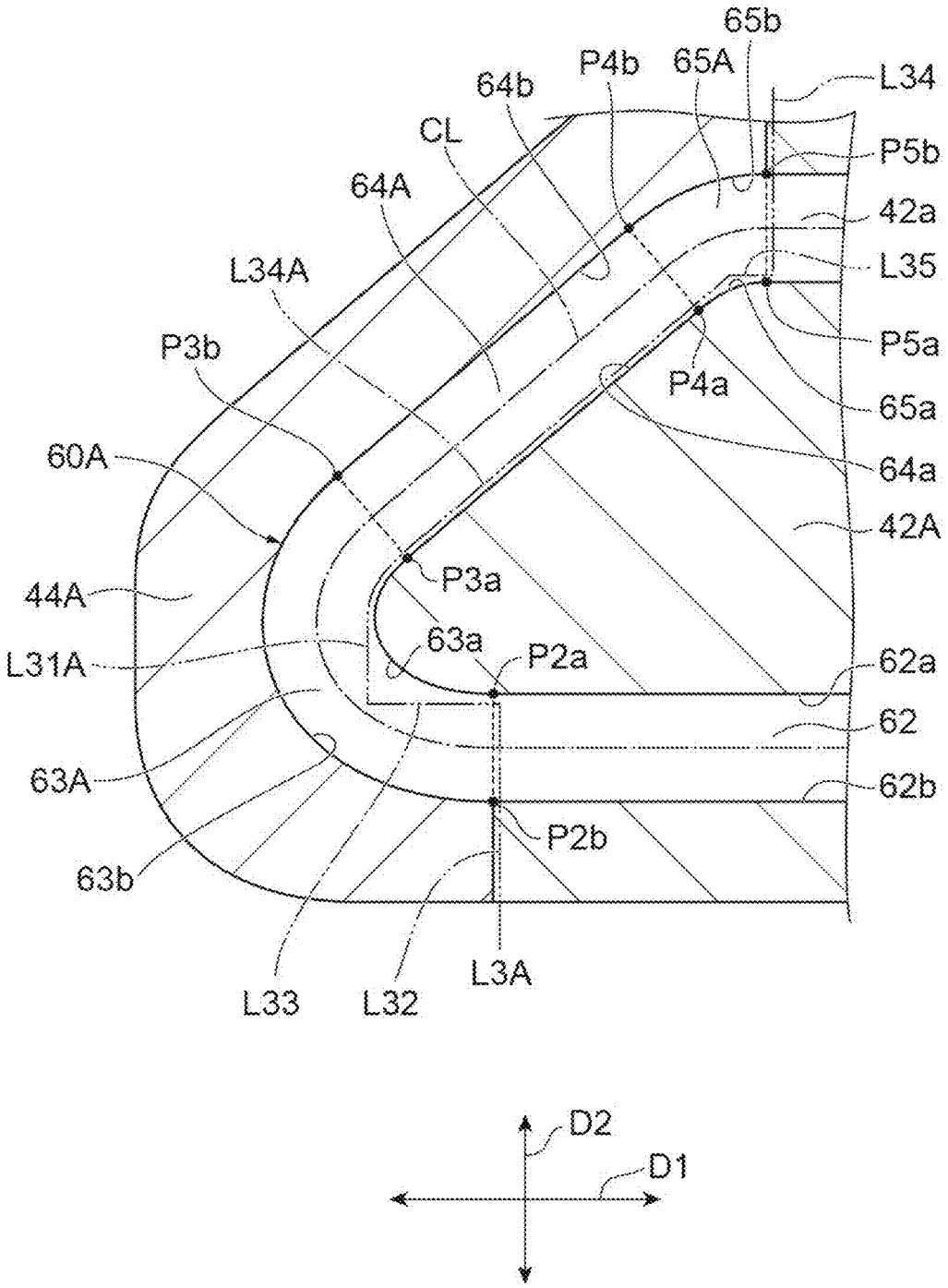
FIG. 9 is an enlarged cross-sectional view of a portion of another example compression device.

In an example illustrated in FIG. 9, a linear passage 64A that connects a curved passage 63A to a curved passage 65A extends in a direction that is inclined from the vertical direction D2. For example, the linear passage 64A extends in a direction that is at an acute angle to the linear passage 62. Accordingly, the curved passage 65A is disposed in a position offset toward the inlet 42*a* in the axial direction D1 relative to the curved passage 63A. A border line L3A indicating the boundary between an interstage housing 44A and a second housing 42A has a border line L31A (second border line) instead of the border line L31. The border line L31A extends upward from the border line L33 (first border line), is curved conforming to the inner wall surface 63*a* so as to be in contact with the terminal end P3*a* of the inner wall surface 63*a*, and then extends linearly along the first wall surface 64*a* to be connected to the border line L35.

Even in the case in which such interstage passage 60A is formed, the inner wall surface 63*a* of the curved passage 63A, the first wall surface 64*a* of the linear passage 64A, and the inner wall surface 65*a* of the curved passage 65A are formed in the second housing 42A by the second housing 42A and the interstage housing 44A being divided by the border line L3A. Additionally, the outer wall surface 63*b* of the curved passage 63A, the second wall surface 64*b* of the linear passage 64A, and the outer wall surface 65*b* of the curved passage 65A are formed in the interstage housing 44A. By thus forming the wall surface of each passage separately in two components (i.e., the second housing 42A and the interstage housing 44A), the components can be shaped to enable demolding. Furthermore, the components can be shaped to enable demolding regardless of the shape of the wall surface of each passage by offsetting the border line L3A in the axial direction D1, similarly to the examples described above. This suppresses situations in which changes occur in the cross-sectional area of the interstage passage 60A, and suppresses situations in which pressure loss occurs in the fluid R that flows through the interstage passage 60A. Consequently, effects similar to those of the examples described above can be obtained even with the example illustrated in FIG. 9.

Figure 10:
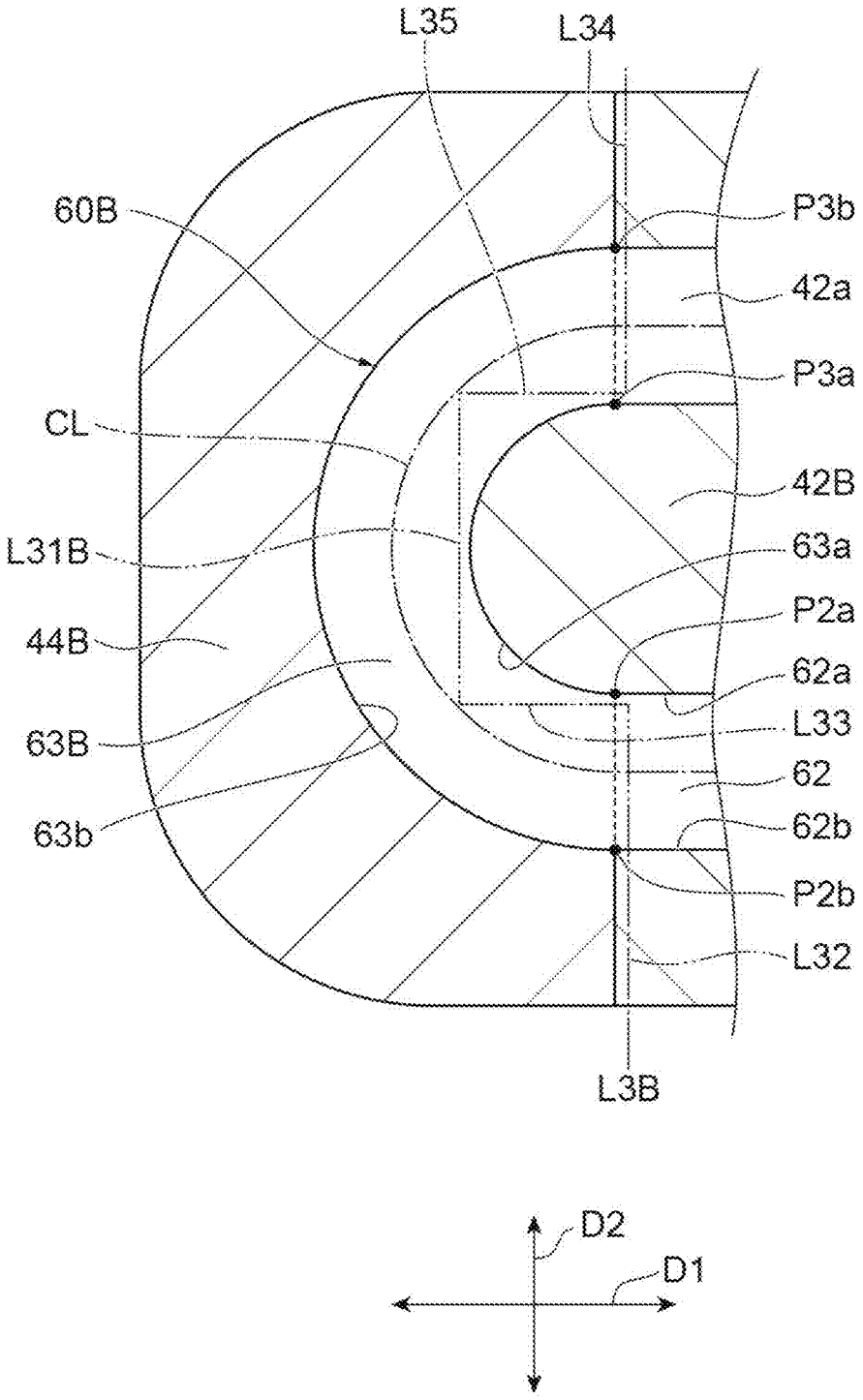
FIG. 10 is an enlarged cross-sectional view of a portion of another example compression device.

In an example illustrated in FIG. 10, a curved passage 63B is directly connected to the inlet 42*a*. As a result, the starting end P2*a* and the terminal end P3*a* of the inner wall surface 63*a* and the starting end P2*b* and the terminal end P3*b* of the outer wall surface 63*b* are aligned in the vertical direction D2. A border line L3B indicating the boundary between an interstage housing 44B and a second housing 42B has a border line L31B instead of the border line L31. The borderline L31B extends in the vertical direction D2 between the inner wall surface 63*a* and the outer wall surface 63*b*. A lower end of the border line L31B is in the same position as the starting end P2*a* of the inner wall surface 63*a* in the vertical direction D2, and is connected to the border line L33 (first border line). An upper end of the border line L31B is in the same position as the terminal end P3*a* of the inner wall surface 63*a* in the vertical direction D2, and is connected to the border line L35 (second border line).

Even in the case in which such interstage passage 60B is formed, the inner wall surface 63*a* of the curved passage 63B is formed in the second housing 42B and the outer wall surface 63*b* of the curved passage 63B is formed in the interstage housing 44B by the second housing 42B and the interstage housing 44B being divided by the border line L3B. By thus forming the wall surface of each passage separately in two components (i.e., the second housing 42B and the interstage housing 44B), the components can be shaped to enable demolding. Additionally, the components can be shaped to enable demolding regardless of the shape of the wall surface of each passage by offsetting the border line L3B in the axial direction D1 similarly to the examples described above, so that situations in which changes occur in the cross-sectional area of the interstage passage 60B can be suppressed, and situations in which pressure loss occurs in the fluid R that flows through the interstage passage 60B can be suppressed. Consequently, effects similar to those of the examples described above can be obtained even with the example illustrated in FIG. 10.

The present disclosure is not limited to the examples described above and the variations, and various other variations are possible. For example, the examples described above and the variations may be combined with each other according to the required object and effect. A two-stage compressor has been described as an example. However, the number of stages of the compressor is not limited to two, and may be three or more. Although an example in which the interstage passage 60 is formed by the four components of the first housing 41, the second housing 42, the interstage plate 43, and the interstage housing 44 has been described, it is not necessarily required to be formed of four components. For example, the interstage plate need not extend downward to reach the interstage passage, and the second housing may be directly connected to the first housing. In this case, the interstage passage will be formed by the three components of the first housing, the second housing, and the interstage housing. In the examples described above, a pipe for connecting the first housing to the second housing may be separately provided. In this case, the pipe may be bypass-connected to the interstage passage.

APPENDIX

The present disclosure includes the following configurations.

A compressor of the present disclosure is [1] "a compressor configured to subject a fluid compressed by a first impeller to further compression by a second impeller, the compressor including: an impeller housing including a first housing accommodating the first impeller, and a second housing accommodating the second impeller; and an interstage component coupled to the impeller housing, and forming, together with the impeller housing, an interstage passage configured to introduce the fluid from the first impeller into the second impeller, wherein the interstage passage includes at least one curved passage, wherein the curved passage includes an inner wall surface that is curved on an inner side in a cross-section passing through a center line of the curved passage, and an outer wall surface that is curved on an outer side in the cross-section, wherein one of the inner wall surface and the outer wall surface is formed in the impeller housing, and wherein another of the inner wall surface and the outer wall surface is formed in the interstage component."

The compressor of the present disclosure is [2] "the compressor according to [1] above, wherein a border line indicating a boundary between the impeller housing and the interstage component in the cross-section includes a first border line and a second border line between the inner wall surface and the outer wall surface, wherein the first border line extends to intersect a straight line connecting a starting end of the inner wall surface to a starting end of the outer wall surface, and wherein the second border line extends to intersect a straight line connecting a terminal end of the inner wall surface to a terminal end of the outer wall surface, and is directly or indirectly connected to the first border line between the inner wall surface and the outer wall surface."

The compressor of the present disclosure is [3] "the compressor according to [1] or [2] above, wherein a distance between the inner wall surface and the outer wall surface in a direction perpendicular to the center line is constant at any position along the center line."

The compressor of the present disclosure is [4] "the compressor according to any one of [1] to [3] above, wherein, in a cross-section perpendicular to the center line of the curved passage, the inner wall surface extends linearly, and the outer wall surface is curved so as to expand from the inner wall surface in a direction opposite the inner wall surface."

The compressor of the present disclosure is [5] "the compressor according to any one of [1] to [4] above, wherein the interstage component is an interstage housing coupled in series to the first housing via the second housing, wherein the inner wall surface is formed in the second housing, and wherein the outer wall surface is formed in the interstage component."

The compressor of the present disclosure is [6] "the compressor according to any one of [1] to [4] above, wherein the interstage component is an interstage plate sandwiched between the first housing and the second housing, wherein the inner wall surface is formed in the interstage component, and wherein the outer wall surface is formed in the first housing."

The compressor of the present disclosure is [7] "the compressor according to any one of [1] to [6] above, wherein the interstage passage further includes a linear passage extending linearly from the curved passage, wherein the linear passage includes a first wall surface connected to the inner wall surface, and a second wall surface connected to the outer wall surface, and wherein the first wall surface and the second wall surface extend parallel to each other in the cross-section passing through the center line, and are formed in the impeller housing."

The invention claimed is:

1. A compressor comprising:

an impeller housing including a first housing accommodating a first impeller configured to compress a fluid, and a second housing accommodating a second impeller configured to further compress the fluid; and an interstage component coupled to the impeller housing, and forming, together with the impeller housing, an interstage passage configured to introduce the fluid from the first impeller into the second impeller, wherein the interstage passage includes a curved passage, wherein in a cross-section taken in a plane that extends along a center line of the curved passage, the curved passage is formed between an inner wall surface that is curved, and an outer wall surface that is curved, wherein a first wall surface selected from the inner wall surface and the outer wall surface is formed by the impeller housing, wherein a second wall surface selected from the inner wall surface and the outer wall surface is formed by the interstage component, and wherein a distance between the inner wall surface and the outer wall surface taken orthogonally to the center line is constant along an entire length of the curved passage.

2. The compressor according to claim 1, wherein a transverse area of the interstage passage, taken orthogonally to the center line, is constant along the entire length of the curved passage.

3. The compressor according to claim 1, wherein, in a transverse cross-section taken orthogonally to the center line of the curved passage, the inner wall surface extends linearly, and the outer wall surface is curved convexly relative to the inner wall surface.

4. The compressor according to claim 1, wherein the interstage component is an interstage housing coupled to the second housing and located opposite the first housing, wherein the inner wall surface of the curved passage is formed by the second housing, and wherein the outer wall surface of the curved passage is formed by the interstage component.

5. The compressor according to claim 1, wherein the interstage component is an interstage plate located between the first housing and the second housing, wherein the inner wall surface of the curved passage is formed by the interstage component, and wherein the outer wall surface of the curved passage is formed by the first housing.

6. The compressor according to claim 1, wherein the interstage passage further includes a linear passage extending linearly from the curved passage, and wherein in a cross-section taken along a center line of the linear passage, an inner wall surface of the linear passage and an outer wall surface of the linear passage are formed by the impeller housing and extend parallel to each other along the linear passage.

7. The compressor according to claim 1, wherein the curved passage is configured to change a flow direction of the fluid between a first direction and a second direction, wherein the curved passage has a first end that is oriented to direct the fluid in the first direction and a second end that is oriented to direct the fluid in the second direction, and wherein in the cross-section taken along the curved passage, the impeller housing contacts the interstage component at a first position along the outer wall surface, that is offset in the first direction from a second position located on the inner wall surface at the second end of the curved passage, and the outer wall surface faces the inner wall surface in the second direction at the first position.

8. The compressor according to claim 7, wherein the interstage passage includes a first linear passage extending in the first direction from the first end of the curved passage and a second linear passage extending in the second direction from the second end of the curved passage, and wherein the first position of the outer wall surface is located at the first end of the curved passage.

9. The compressor according to claim 7, wherein an inner component selected from the impeller housing and the interstage component forms the inner wall surface along the curved passage, and additionally forms a portion of the outer wall surface adjacent to the first position, wherein an outer component selected from the impeller housing and the interstage component forms the outer wall surface along the curved passage, wherein a first width of the inner component is taken in the first direction at the second end of the curved passage, and wherein a second width of the inner component taken in the first direction along the outer wall surface is less than the first width.

10. The compressor according to claim 1, wherein the curved passage has a terminal end at which the inner wall surface faces the outer wall surface in a first direction, and a starting end at which the inner wall surface faces the outer wall surface in a second direction different from the first direction, wherein a border line extending in the curved passage between the impeller housing and the interstage component in the cross-section, includes a first border line and a second border line between the inner wall surface and the outer wall surface, wherein the first border line intersects the first direction, and wherein the second border line extends from the first border line in a direction that intersects the second direction.

11. A compressor comprising:

an impeller housing accommodating a first impeller configured to compress a fluid and a second impeller configured to further compress the fluid; and an interstage component coupled to the impeller housing, wherein the interstage component and the impeller housing form an interstage passage that is configured to direct the fluid from the first impeller to the second impeller in a flow direction, wherein the interstage passage includes a curved passage configured to change the flow direction between a first direction and a second direction, wherein the curved passage has a first end that is oriented to direct the fluid in the first direction and a second end that is oriented to direct the fluid in the second direction, wherein in a cross-section of the interstage passage taken in a plane that extends along the flow direction, the curved passage is formed between an inner wall surface and an outer wall surface of the interstage passage, wherein an inner component selected from the impeller housing and the interstage component, forms the inner wall surface along an entire length of the curved passage, and an outer component selected from the other of the impeller housing and the interstage component, forms the outer wall surface along the entire length of the curved passage, wherein in the cross-section, the inner component contacts the outer component at a first position along the outer wall surface, that is offset in the first direction from a second position located on the inner wall surface at the second end of the curved passage, and the outer wall surface faces the inner wall surface in the second direction at the first position, wherein a first width of the inner component forming the inner wall surface is taken in the first direction at the second end of the curved passage, wherein the inner component forms a portion of the outer wall surface adjacent to the first position, and wherein a second width of the inner component taken in the first direction along the outer wall surface is less than the first width.

12. The compressor according to claim 11, wherein the interstage passage includes a first linear passage extending in the first direction from the first end of the curved passage and a second linear passage extending in the second direction from the second end of the curved passage, and wherein the first position along the outer wall surface is located at the first end of the curved passage.

13. The compressor according to claim 12, wherein the interstage component and the impeller housing are arranged in the first direction, wherein the inner wall surface extends in the second direction along the second linear passage, and wherein the interstage component contacts the impeller housing along a border line extending in the second direction from the first position of the outer wall surface, wherein the border line is offset in the first direction, from the inner wall surface of the second linear passage.

14. The compressor according to claim 11, wherein in the cross-section of the interstage passage, the inner wall surface is curved from the first end to the second end of the curved passage, the outer wall surface is curved from the first end to the second end of the curved passage, and a distance between the inner wall surface and the outer wall surface is constant along the entire length of the curved passage.

15. The compressor according to claim 11, wherein the inner wall surface of the curved passage is formed by the impeller housing, and the outer wall surface of the curved passage is formed by the interstage component.

16. The compressor according to claim 15, wherein the impeller housing includes a first housing configured to accommodate the first impeller and a second housing configured to accommodate the second impeller, wherein the interstage component includes an interstage housing, wherein the second housing is interposed between the first housing and the interstage housing, and wherein the inner wall surface of the curved passage is formed by the second housing and the outer wall surface of the curved passage is formed by the interstage housing.

17. The compressor according to claim 11, wherein the inner wall surface of the curved passage is formed by the interstage component, and the outer wall surface of the curved passage is formed by the impeller housing.

18. The compressor according to claim 17, wherein the impeller housing includes a first housing configured to accommodate the first impeller and a second housing configured to accommodate the second impeller, wherein the interstage component includes an interstage plate located between the first housing and the second housing, and wherein the inner wall surface of the curved passage is formed by the interstage plate and the outer wall surface of the curved passage is formed by the first housing.

19. A compressor comprising:

an impeller housing accommodating a first impeller configured to compress a fluid and a second impeller configured to further compress the fluid; and an interstage component coupled to the impeller housing, wherein the interstage component and the impeller housing form an interstage passage that is configured to direct the fluid from the first impeller to the second impeller in a flow direction, wherein the interstage passage includes a curved passage configured to change the flow direction between a first direction and a second direction, wherein the curved passage has a first end that is oriented to direct the fluid in the first direction and a second end that is oriented to direct the fluid in the second direction, wherein in a cross-section of the interstage passage taken in a plane that extends along the flow direction, the curved passage is formed between an inner wall surface and an outer wall surface of the interstage passage, wherein an inner component selected from the impeller housing and the interstage component, forms the inner wall surface along an entire length of the curved passage, and an outer component selected from the other of the impeller housing and the interstage component, forms the outer wall surface along the entire length of the curved passage, wherein in the cross-section, the inner component contacts the outer component at a first position along the outer wall surface, that is offset in the first direction from a second position located on the inner wall surface at the second end of the curved passage, and the outer wall surface faces the inner wall surface in the second direction at the first position, and wherein in a transverse cross-section of the curved passage taken orthogonally to the flow direction, the inner wall surface is linear and the outer wall surface is curved convexly relative to the inner wall surface.

20. The compressor according to claim 19, wherein in the cross-section of the interstage passage, the inner wall surface is curved from the first end to the second end of the curved passage, the outer wall surface is curved from the first end to the second end of the curved passage, and a distance between the inner wall surface and the outer wall surface is constant along the entire length of the curved passage.

* * * * *